US009013392B2

(12) United States Patent
Yen et al.

(10) Patent No.: US 9,013,392 B2
(45) **Date of Patent: *Apr. 21, 2015**

(54) GAMMA-VOLTAGE GENERATOR

(71) Applicant: Novatek Microelectronics Corp., Hsinchu (TW)

(72) Inventors: Chih-Jen Yen, Hsinchu (TW); Yueh-Hsiu Liu, Hsinchu (TW); Ju-Lin Huang, Hsinchu County (TW); Peng-Yu Chen, Hsinchu (TW); Yu-Shao Liu, Kaohsiung (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,304

(22) Filed: Oct. 21, 2013

(65) Prior Publication Data

US 2014/0043313 A1 Feb. 13, 2014

Related U.S. Application Data

(63) Continuation of application No. 13/442,882, filed on Apr. 10, 2012, now Pat. No. 8,593,389, which is a continuation-in-part of application No. 12/690,087, filed on Jan. 19, 2010, now Pat. No. 8,174,481.

(30) Foreign Application Priority Data

Sep. 23, 2009 (TW) ..... 98132120 A

(51) Int. Cl.
*G09G 3/36* (2006.01)

(52) U.S. Cl.
CPC ..... *G09G 3/3696* (2013.01); *G09G 3/3614* (2013.01); *G09G 3/3688* (2013.01); *G09G 2310/027* (2013.01); *G09G 2310/0297* (2013.01); *G09G 2320/0673* (2013.01)

(58) Field of Classification Search
USPC ..... 345/87, 89, 94, 95, 98–100
See application file for complete search history.

(56) References Cited

U.S. PATENT DOCUMENTS 8,305,321 B2 * 11/2012 Park et al. ..... 345/98
2007/0090983 A1 * 4/2007 Yen ..... 341/155

* cited by examiner

*Primary Examiner* — Ricardo L Osorio
(74) *Attorney, Agent, or Firm* — Jianq Chyun IP Office

(57) ABSTRACT

A gamma-voltage generator is provided to generating a plurality of first gamma voltages and second gamma voltages. At least one of the first gamma voltages generated by DACs of the gamma-voltage generator within a first frame period and at least one of the second gamma voltages generated by the DACs within a second frame period are outputted from a same one of the gamma buffers of the gamma-voltage generator, whereby the transmitted gamma voltages have substantially equal offset. Therefore, the display quality approaches an ideal condition.

11 Claims, 24 Drawing Sheets

GAMMA-VOLTAGE GENERATOR

CROSS-REFERENCE TO RELATED APPLICATION

This application is a continuation application of and claims the priority benefit of U.S. application Ser. No. 13/442,882, filed on Apr. 10, 2012, now allowed, which is a continuation-in-part application of and claims the priority benefit of a prior application Ser. No. 12/690,087, filed on Jan. 19, 2010, now U.S. Pat. No. 8,174,481. The prior application Ser. No. 12/690,087 claims the priority benefit of Taiwan application serial no. 98132120, filed on Sep. 23, 2009. The entirety of each of the above-mentioned patent applications is hereby incorporated by reference herein and made a part of this specification.

BACKGROUND OF THE INVENTION

1. Field of the Invention

The invention is generally related to a gamma-voltage generator, and more particularly, to a gamma-voltage generator configured to provide gamma voltages with different polarities through a same gamma buffer thereof within different frame periods.

2. Description of Related Art

With the rapid progress in video broadcasting and communication technology, liquid crystal display devices have been used as a display screen in many types of consumer electronic products such as the mobile phones, the notebook computers, the personal computers, and the personal digital assistants (PDAs). Since a liquid crystal display panel itself cannot emit light, it is necessary to dispose a backlight module behind the panel to serve as a light source required by the liquid crystal display panel. Moreover, the light transmittance of the liquid crystal panel is determined by the rotational angles of the liquid crystal molecules within the liquid crystal panel. In particular, the rotational angles of the liquid crystal molecules in the pixels are related to the voltage differences between the pixel electrodes of the pixels and the common electrode. Since the voltage (i.e. common voltage) applied to the common electrode is typically fixed, the pixel light transmittance can be controlled by manipulating the gamma voltages applied on the pixel electrodes.

Driving circuits of conventional liquid crystal displays utilize gamma buffers to stabilize the gamma voltages. Ideally, an ideal gamma buffer has no output error. In other words, in view of the ideal gamma buffer, there is no difference between an input gamma voltage and an output gamma voltage. Referring to FIGS. 1 and 2, FIG. 1 is a diagram illustrating relationships between a DEV voltage of a driving circuit using an idealized gamma buffer and each graylevel. FIG. 2 is a diagram illustrating relationships between a root mean square (RMS) of a driving circuit using an idealized gamma buffer and each graylevel. The DEV voltage is defined as a difference value obtained by subtracting the gamma voltage outputted from the driving circuit by a predetermined idealized voltage. Each of the curves 30(1)-30(*n*) depicted in FIG. 1 represents a corresponding line of pixels of the liquid crystal display, respectively. Each of the curves 32(1)-32(*n*) also represents a corresponding line of pixels of the liquid crystal display, respectively. In different frame periods, the liquid crystal display outputs gamma voltages with different polarities. The left side and the right side of FIG. 1 illustrate the situations of the liquid crystal display at negative and positive polarity respectively. It should be noted that the voltages with positive polarity are usually defined as voltages that are greater than the common voltage, and the voltages with negative polarity are usually defined as voltages that are less than the common voltage, and the common voltage may be greater than the ground voltage (i.e. 0 volt) or less than the ground voltage.

However, because the driving circuits of the conventional liquid crystal displays utilize different gamma buffers to output gamma voltages for driving pixels, and because different errors exist between the input voltages and the output voltages of different gamma buffers, the display quality of the liquid crystal display deteriorates. Referring to FIGS. 3 and 4, FIG. 3 is a schematic diagram of a driving circuit 50 of a conventional liquid crystal display during a first frame period, and FIG. 4 is a schematic diagram of the driving circuit 50 during a second frame period. The driving circuit 50 has a first gamma buffer 52(1), a second gamma buffer 52(2), a plurality of digital-to-analog converters (DACs) 54(1)-54(*n*), and a plurality of operational amplifiers 56(1)-56(*n*). The driving circuit 50 is configured to output a plurality of gamma voltages to a plurality of lines of pixels 58(1)-58(*n*) in the liquid crystal display, so as to drive the liquid crystal molecules in the pixels to rotate. The first gamma buffer 52(1) receives a plurality of positive polarity gamma voltages, whereas the second gamma buffer 52(2) receives a plurality of negative polarity gamma voltages. The first gamma buffer 52(1) and the second gamma buffer 52(2) buffer and then output the received gamma voltages to the DACs 54(1)-54(*n*). Thereafter, according to display requirements, the DACs 54(1)-54(*n*) respectively select and thereafter output one corresponding gamma voltage of the gamma voltages transmitted from the first gamma buffer 52(1) and the second gamma buffer 52(2).

In the above-described first frame period, the odd-numbered DACs 54(1), . . . , 54(*n*−3), and 54(*n*−1) output positive polarity gamma voltages, whereas the even-numbered DACs 54(2), . . . , 54(*n*−2), and 54(*n*) output negative polarity gamma voltages. Moreover, in the above-mentioned second frame period, the odd-numbered DACs 54(1), . . . , 54(*n*−3), and 54(*n*−1) output negative polarity gamma voltages, whereas the even-numbered DACs 54(2), . . . , 54(*n*−2), and 54(*n*) output positive polarity gamma voltages.

However, during the first and second frame periods, because the gamma voltages received by pixels of a same line are respectively buffered by the first gamma buffer 52(1) and the second gamma buffer 52(2), whereby the first gamma buffer 52(1) and the second gamma buffer 52(2) have different errors (input voltages versus output voltages), the display quality of the liquid crystal display deteriorates. Referring to FIG. 5, FIG. 5 is a diagram illustrating relationships between the DEV voltage of the driving circuit 50 and each graylevel. The DEV voltage is defined as a difference value obtained by subtracting the gamma voltage the driving circuit 50 outputs to the pixels by a predetermined idealized voltage. A plurality of curves 60(1,−)-60(*n*,−) depicted in FIG. 5 represent the corresponding curves when the pixels receive negative polarity gamma voltages. A plurality of curves 60(1,+)-60(*n*,+) represent the corresponding curves when the pixels receive positive polarity gamma voltages. Compared with the idealized curves depicted in FIG. 1, the curves 60(1,−)-60(*n*,−) and 60(1,+)-60(*n*,+) depicted in FIG. 5 significantly deviate from the ideal case. Moreover, referring to FIG. 6, FIG. 6 is a diagram illustrating relationships between the RMS of the driving circuit 50 and each graylevel. Each of a plurality of curves 62(1)-62(*n*) respectively correspond to a line of the lines of pixels 58(1)-58(*n*). Compared with the curves depicted in FIG. 2, the curves 62(1)-62(*n*) depicted in FIG. 6 significantly deviate from the ideal case.

SUMMARY OF THE INVENTION

An aspect of the invention provides a gamma-voltage generator to generate a plurality of gamma voltages. A plurality of gamma voltages transmitted to a display panel during different frame periods are buffered by a same gamma buffer, whereby the transmitted gamma voltages have substantially equal offset. Therefore, the display quality approaches an ideal condition.

Another aspect of the invention provides a gamma-voltage generator. The gamma-voltage generator comprises a plurality of digital-to-analog converters (DACs), a plurality of gamma buffers, a plurality of terminals, a first switching circuit and a second switching circuit. The DACs convert a digital signal into a plurality of gamma voltages. The gamma buffers are coupled to the DACs for buffering the gamma voltages and outputting the buffered gamma voltages. The terminals are coupled to the gamma buffers for receiving and outputting the buffered gamma voltages. The first switching circuit is coupled between the DACs and the gamma buffers. The second switching circuit is coupled between the gamma buffers and the terminals.

In one embodiment of the invention, the first switching circuit and the second switching circuit are configured such that at least one of a plurality of first gamma voltages of the gamma voltages generated by the DACs within a first period and at least one of a plurality of second gamma voltages of the gamma voltages generated by the DACs within a second period are outputted from a same one of the gamma buffers.

In one embodiment of the invention, the DACs comprise a plurality of first DACs and a plurality of second DACs, and the gamma buffers comprise a plurality of first gamma buffers and a plurality of second buffers. The first switching circuit connects the first DACs to the first gamma buffers and connects the second DACs to the second gamma buffers within a first period. The first switching circuit connects the first DACs to the second gamma buffers and connects the second DACs to the first gamma buffers within a second period. The terminals comprise a plurality of first terminals and a plurality of second terminals. The second switching circuit connects the first gamma buffers to the first terminals and connects the second gamma buffers to the second terminals within the first period, and the second switching circuit connects the first gamma buffers to the second terminals and connects the second gamma buffers to the first terminals within the second period.

Another aspect of the invention provides a gamma-voltage generator. The gamma-voltage generator comprises a plurality of DACs, a plurality of gamma buffers, a plurality of terminals, a first switching circuit and a second switching circuit. The DACs convert a digital signal into a plurality of gamma voltages. The gamma buffers are coupled to the DACs for buffering the gamma voltages and outputting the buffered gamma voltages. The terminals are coupled to the gamma buffers for receiving and outputting the buffered gamma voltages. The first switching circuit is coupled to the DACs for receiving the digital signal. The second switching circuit is coupled between the gamma buffers and the terminals.

In one embodiment of the invention, the first switching circuit and the second switching circuit are configured such that at least one of a plurality of first gamma voltages of the gamma voltages generated by the DACs within a first period and at least one of a plurality of second gamma voltages of the gamma voltages generated by the DACs within a second period are outputted from a same one of the gamma buffers.

In one embodiment of the invention, the DACs comprise a plurality of first DACs and a plurality of second DACs, and the gamma buffers comprise a plurality of first gamma buffers and a plurality of second gamma buffers. The first switching circuit transmits the first bits of the digital signal to the first DACs and transmits the second bits of the digital signal to the second DACs within a first period, and the first switching circuit transmits the second bits of the digital signal to the first DACs and transmits the first bits of the digital signal to the second DACs within a second period. The terminals comprise a plurality of first terminals and a plurality of second terminals. The second switching circuit connects the first gamma buffers to the first terminals and connects the second gamma buffers to the second terminals within the first period, and the second switching circuit connects the first gamma buffers to the second terminals and connects the second gamma buffers to the first terminals within the second period.

In one embodiment of the invention, the DACs comprise a plurality of first DACs and a plurality of second DACs. The first DACs generate a plurality of first gamma voltages of the gamma voltages according to first bits of the digital signal within a first period and generate a plurality of second gamma voltages of the gamma voltages according to a plurality of second bits of the digital signal within a second period. The second DACs generate the first gamma voltages according to the first bits of the digital signal within the second period and generate the second gamma voltages according to the second bits of the digital signal within the first period.

In one embodiment of the invention, the first switching circuit comprises a first register and a second register.

In one embodiment of the invention, first sections of the first register temporarily store a plurality of first bits of the digital signal, and second sections of the first register temporarily store a plurality of second bits of the digital signal. First sections of the second register receive one of the first bits and the second bits of the digital signal from one of the first sections and the second sections of the first register and output the one of the first bits and the second bits of the digital signal to first DACs of the DACs, and second sections of the second register receive the other one of the first bits and the second bits of the digital signal from the other one of the first sections and the second sections of the first register and output the other one of the first bits and the second bits of the digital signal to second DACs of the DACs.

In one embodiment of the invention, the first sections of the second register receive the first bits of the digital signal from the first sections of the first register and output the first bits of the digital signal to the first DACs within a first period, and the second sections of the second register receive the second bits of the digital signal from the second sections of the first register and output the second bits of the digital signal to the second DACs within the first period. The first sections of the second register receive the second bits of the digital signal from the second sections of the first register and output the second bits of the digital signal to the first DACs within a second period, and the second sections of the second register receive the first bits of the digital signal from the first sections of the first register and output the first bits of the digital signal to the second DACs within the second period.

In one embodiment of the invention, the DACs are further coupled to a non-volatile memory configured to store a setting value and generate the digital signal according to the setting value.

Another aspect of the invention provides a gamma-voltage generator. The gamma-voltage generator comprises a plurality of DACs, a plurality of gamma buffers, a plurality of terminals and a switching circuit. The DACs convert a digital signal into a plurality of gamma voltages, in which the DACs comprise a plurality of first DACs and a plurality of second DACs. The gamma buffers are coupled to the DACs for buffering the gamma voltages and outputting the buffered gamma voltages, in which the gamma buffers comprise a plurality of first gamma buffers and a plurality of second gamma buffers, each of the gamma buffers coupled to a corresponding one of the first DACs and a corresponding one of the second DACs. The terminals are coupled to the gamma buffers for receiving and outputting the buffered gamma voltages. The switching circuit is coupled between the gamma buffers and the terminals.

In one embodiment of the invention, the switching circuit is configured such that at least one of a plurality of first gamma voltages of the gamma voltages generated by the DACs within a first period and at least one of a plurality of second gamma voltages of the gamma voltages generated by the DACs within a second period are outputted from a same one of the gamma buffers.

In one embodiment of the invention, the terminals comprise a plurality of first terminals and a plurality of second terminals. Within a first period, the first gamma buffers receive first gamma voltages of the gamma voltages from the corresponding first DACs, the second gamma buffers receive second gamma voltages of the gamma voltages from the corresponding second DACs, and the switching circuit connects the first gamma buffers to first terminals and connects the second gamma buffers to second terminals. Within a second period, the first gamma buffers receive the second gamma voltages from the corresponding second DACs, the second gamma buffers receive the first gamma voltages from the corresponding first DACs, and the switching circuit connects the first gamma buffers to the second terminals and connects the second gamma buffers to the first terminals.

In summary, a gamma-voltage generator is provided to generating a plurality of first gamma voltages and second gamma voltages. At least one of the first gamma voltages generated by DACs of the gamma-voltage generator within a first frame period and at least one of the second gamma voltages generated by the DACs within a second frame period are outputted from a same one of the gamma buffers of the gamma-voltage generator, whereby the transmitted gamma voltages have substantially equal offset. Therefore, the display quality approaches an ideal condition.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 7:
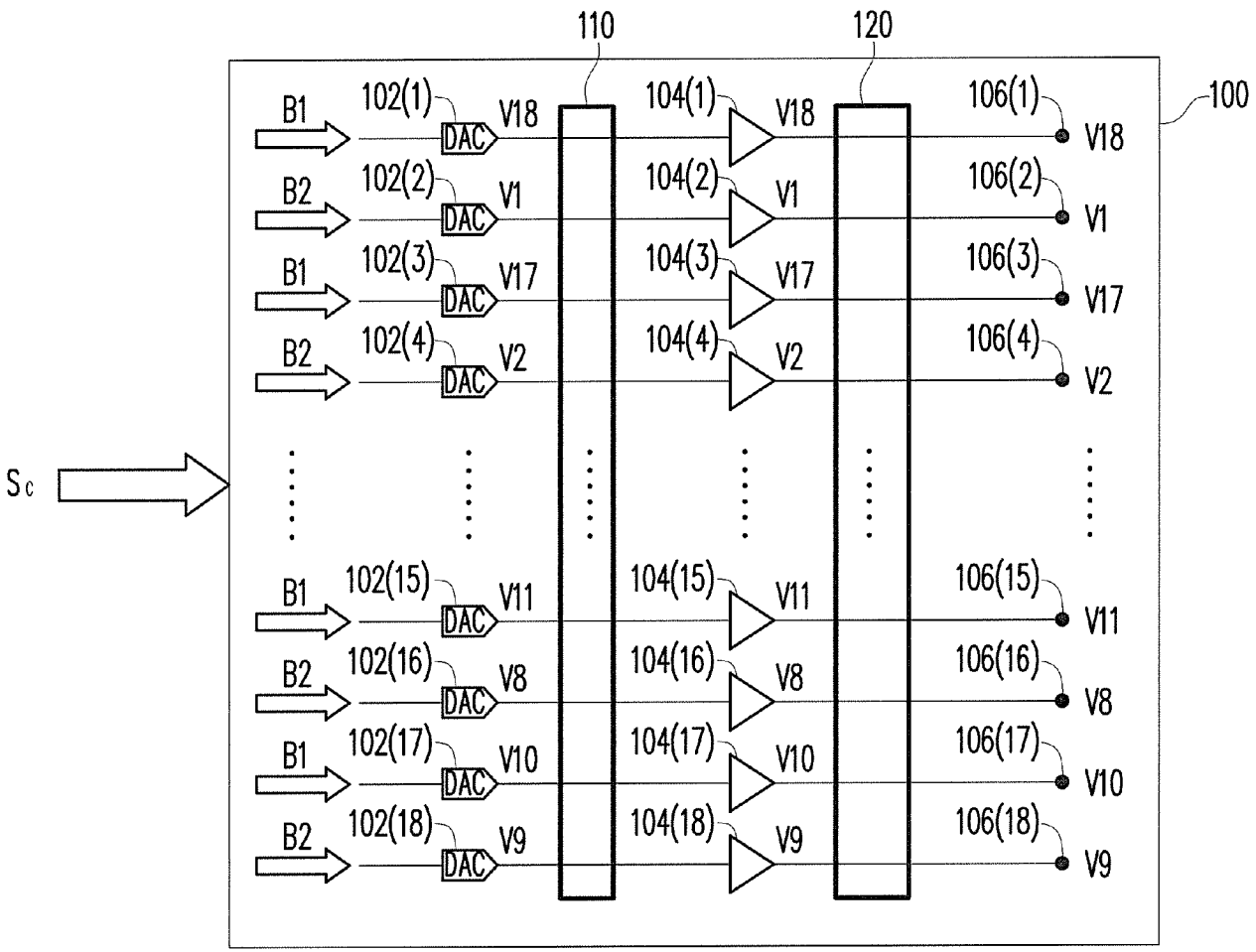
FIG. 7 is a schematic diagram of a gamma-voltage generator during a first frame period in accordance with an embodiment of the invention.
Figure 8:
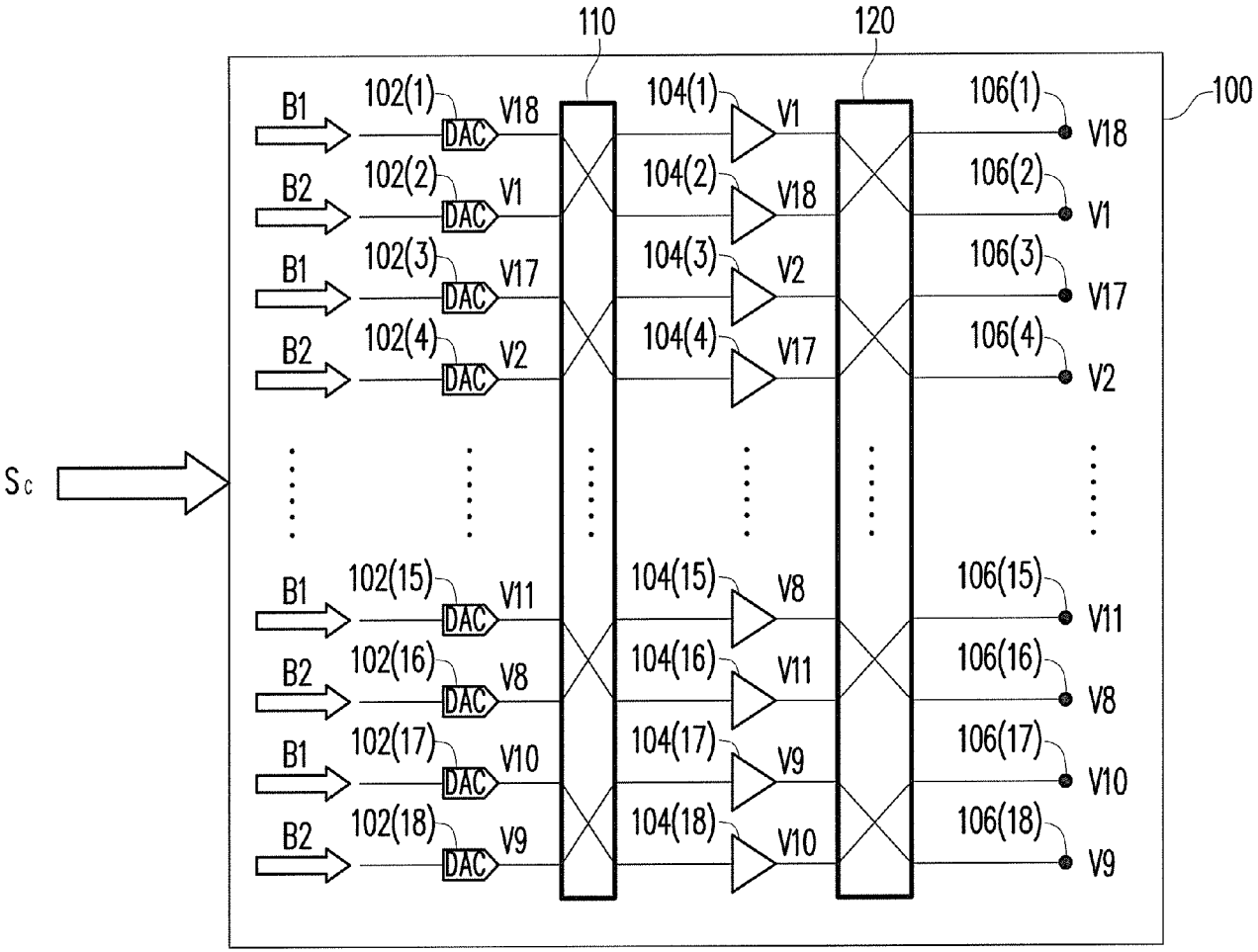
FIG. 8 is a schematic diagram of the gamma-voltage generator depicted in FIG. 7 during a second frame period.

Referring to FIGS. 7 and 8, FIG. 7 is a schematic diagram of a gamma-voltage generator 100 during a first frame period in accordance with an embodiment of the invention. FIG. 8 is a schematic diagram of the gamma-voltage generator 100 during a second frame period. The gamma-voltage generator 100 has a plurality of digital-to-analog converters (DACs) 102(1)-102(18), a plurality of gamma buffers 104(1)-104(18) and a plurality of terminals 106(1)-106(18). It should be noted that the total number of the DACs 102(1)-102(18), gamma buffers 104(1)-104(18) and a plurality of terminals 106(1)-106(18) could be other numbers, and the invention is not limited thereto. The DACs 102(1)-102(18) receive first bits B1 and second bits B2 of a digital signal $S_C$. In addition, the DACs 102(1)-102(18) convert the first bits B1 into first gamma voltages V18 to V10, and convert the second bits B2 into second gamma voltages V1 to V9.

In the embodiment of the invention, the first gamma voltages V18 to V10 are positive polarity voltages, whereas the second gamma voltages V1 to V9 are negative polarity voltages. However, the invention should not be construed as limited thereto. For example, in another embodiment of the invention, the first gamma voltages V18 to V10 are negative polarity voltages, whereas the second gamma voltages V1 to V9 are positive polarity voltages. Broadly speaking, the positive polarity voltages could be regarded as voltages that are greater than a common voltage, and the negative polarity voltages could be regarded as voltages that are less than the common voltage, where a plurality of common electrodes of the first pixels and the second pixels are coupled to the common voltage, and the common voltage may be greater than the ground voltage (i.e. 0 volt) or less than the ground voltage.

In an embodiment of the invention, the first gamma voltages V18 to V10 are different from each other, and the second gamma voltages V1 to V9 are different from each other. Each of the first gamma voltages V18 to V10 is corresponding to one of the second gamma voltages V1 to V9, and each of the first gamma voltages V18 to V10 and its corresponding one of the second gamma voltages V1 to V9 are referred to as a group. In the embodiment, the first gamma voltage V18 and the second gamma voltage V1 are in the same group, the first gamma voltage V17 and the second gamma voltage V2 are in the same group, the first gamma voltage V11 and the second gamma voltage V8 are in the same group, the first gamma voltage V10 and the second gamma voltage V9 are in the same group, and so on. In each group, the difference between the first gamma voltage of the group and the common voltage is equal to the difference between the common voltage and the corresponding second gamma voltage. For example, the difference between the first gamma voltage V18 and the common voltage is equal to the difference between the common voltage and the second gamma voltage V1.

The gamma buffers 104(1)-104(18) are coupled to the DACs 102(1)-102(18) to receive and buffer the first gamma voltages V18 to V10 and second gamma voltages V1 to V9. The gamma buffers 104(1)-104(18) output the buffered first gamma voltages V18 to V10 and the buffered second gamma voltages V1 to V9 to the terminals 106(1)-106(18). The terminals 106(1)-106(18) receive and output the buffered first gamma voltages V18 to V10 and the buffered second gamma voltages V1 to V9.

For ease of description, in the embodiments described hereinafter, all the odd-numbered DACs 102(1), 102(3), . . . , 102(15), and 102(17) of the DACs 102(1)-102(18) are referred to as the first DACs, and all the even-numbered DACs 102(2), 102(4), . . . , 102(16), and 102(18) of the DACs 102(1)-102(18) are referred to as the second DACs. Moreover, all the odd-numbered gamma buffers 104(1), 104(3), . . . , 104(15), and 104(17) of the gamma buffers 104(1)-104(18) are referred to as the first gamma buffers, and all the even-numbered gamma buffers 104(2), 104(4), . . . , 104(16), and 104(18) of the gamma buffers 104(1)-104(18) are referred to as the second gamma buffers. In addition, the odd-numbered terminals 106(1), 106(3), . . . , 106(15), and 106(17) of the terminals 106(1)-106(18) are referred to as the first terminals, and all the even-numbered gamma buffers 106(2), 106(4), . . . , 106(16), and 106(18) of the terminals 106(1)-106(18) are referred to as the second terminals.

As shown in FIG. 7, during the first frame period, the first DACs 102(1), 102(3), . . . , 102(15), and 102(17) receive the first bits B1 of the digital signal $S_C$ and convert the first bits B1 into the first gamma voltages V18 to V10, and the second DACs 102(2), 102(4), . . . , 102(16), and 102(18) receive the second bits B2 of the digital signal $S_C$ and convert the second bits B2 into the second gamma voltages V1 to V9. Moreover, during the first frame period, the first gamma buffer 104(1), 104(3), . . . , 104(15), and 104(17) receive and buffer the first gamma voltages V18 to V10, and the second gamma buffer 104(2), 104(4), . . . , 104(16), and 104(18) receive and buffer the second gamma voltages V1 to V9. In addition, during the first frame period, the first terminals 106(1), 106(3), . . . , 106(15), and 106(17) receive and output the buffered first gamma voltages V18 to V10, and the second terminals 106(2), 106(4), . . . , 106(16), and 106(18) receive and output the buffered second gamma voltages V1 to V9.

The gamma-voltage generator 100 further comprises a first switching circuit 110 and a second switching circuit 120. The first switching circuit 110 is coupled between the DACs 102(1)-102(18) and the gamma buffers 104(1)-104(18), and the second switching circuit 120 is coupled between the gamma buffers 104(1)-104(18) and the terminals 106(1)-106(18). During the first frame period, the first switching circuit 110 connects the first DACs 102(1), 102(3), . . . , 102(15), and 102(17) to the first gamma buffers 104(1), 104(3), . . . , 104(15), and 104(17) and connects the second DACs 102(2), 102(4), . . . , 102(16), and 102(18) to the second gamma buffers 104(2), 104(4), . . . , 104(16), and 104(18). Moreover, during the first frame period, the second switching circuit 120 connects the first gamma buffers 104(1), 104(3), . . . , 104(15), and 104(17) to the first terminals 106(1), 106(3), . . . , 106(15), and 106(17) and connects the second gamma buffers 104(2), 104(4), . . . , 104(16), and 104(18) to the second terminals 106(2), 106(4), . . . , 106(16), and 106(18).

As shown in FIG. 8, during the second frame period, the first switching circuit 110 connects the first DACs 102(1), 102(3), . . . , 102(15), and 102(17) to the second gamma buffers 104(2), 104(4), . . . , 104(16), and 104(18) and connects the second DACs 102(2), 102(4), . . . , 102(16), and 102(18) to the first gamma buffers 104(1), 104(3), . . . , 104(15), and 104(17). Moreover, during the second frame period, the second switching circuit 120 connects the first gamma buffers 104(1), 104(3), . . . , 104(15), and 104(17) to the second terminals 106(2), 106(4), . . . , 106(16), and 106(18) and connects the second gamma buffers 104(2), 104(4), . . . , 104(16), and 104(18) to the first terminals 106(1), 106(3), . . . , 106(15), and 106(17). Therefore, during the second frame period, the first gamma voltage V18 to V10 are outputted from the first terminals 106(1), 106(3), . . . , 106(15), and 106(17), and the second gamma voltage V1 to V9 are outputted from the second terminals 106(2), 106(4), . . . , 106(16), and 106(18).

Figure 9:
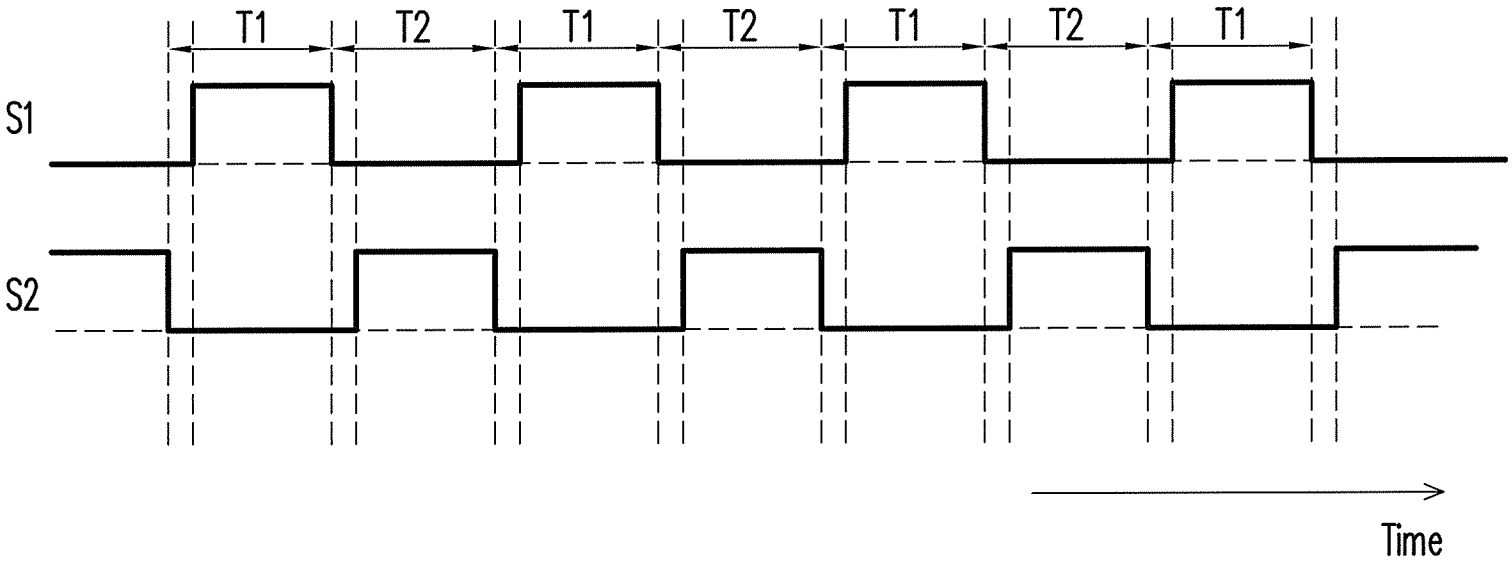
FIG. 9 is a timing diagram of a first control signal S1 and a second control signal S2 used to control the driving circuit depicted in FIG. 7.

In one embodiment of the invention, the first switching circuit 110 and the second switching circuit 120 perform switching according to a first control signal S1 and a second control signal S2. Referring to FIG. 9, FIG. 9 is a timing diagram of the first control signal S1 and the second control signal S2. During the first frame periods T1, the first control signal S1 is at a high potential, whereas the second control signal S2 is at a low potential. In addition, during the second frame periods T2, the first control signal S1 is at the low potential, whereas the second control signal S2 is at the high potential. As shown in FIG. 9, the above-described first and second frame periods are not overlapped along the time axis. In an embodiment of the invention, within each of the first frame periods T1 and the second frame periods T2, the gamma-voltage generator 100 provides the gamma voltages V1 to V18 to one or more source drivers, such that the source driver(s) could drive a panel to display an image within the corresponding frame period.

Figure 10:
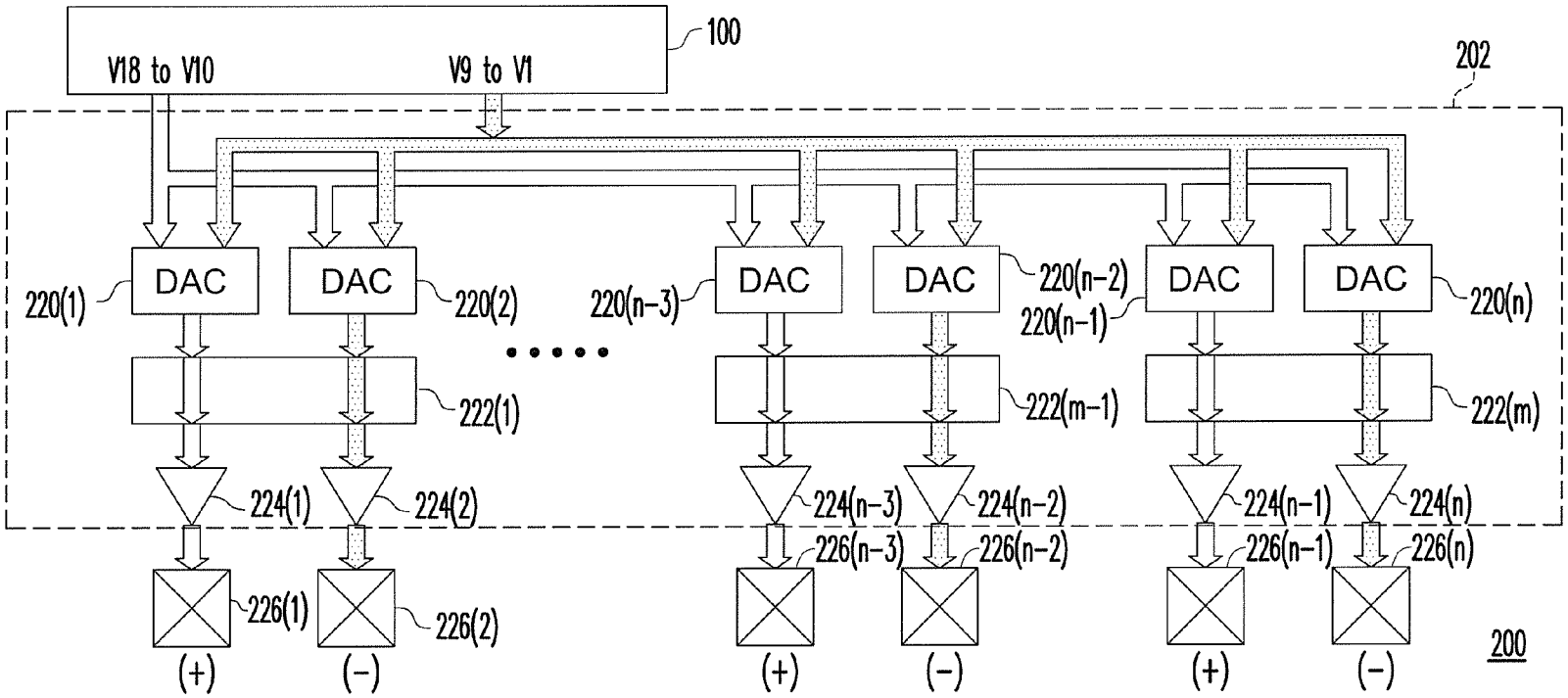
FIG. 10 is a schematic diagram of a liquid crystal display with a gamma-voltage generator that operates within a first frame period in accordance with an embodiment of the invention.
Figure 11:
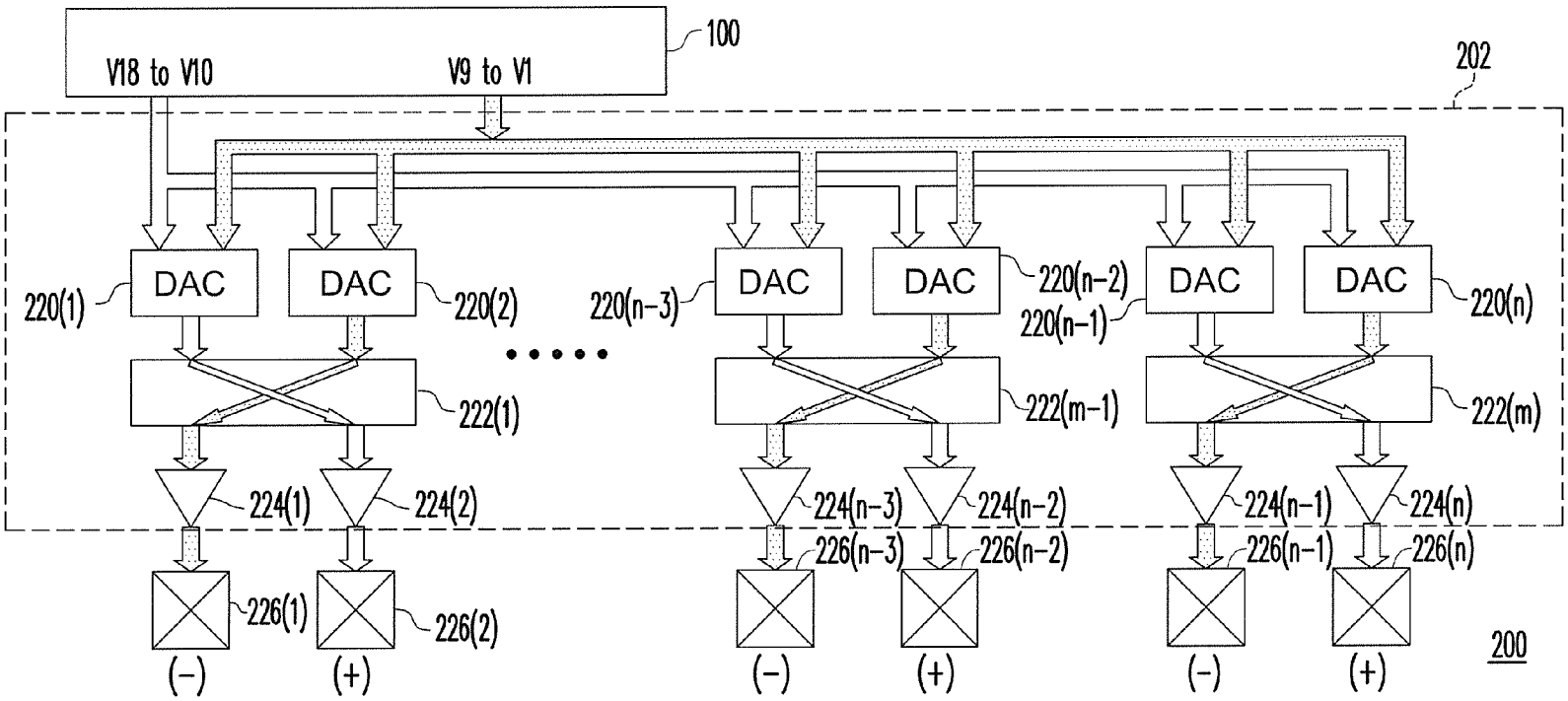
FIG. 11 is a schematic diagram of the liquid crystal display depicted in FIG. 10 during a second frame period.

Referring to FIGS. 10 and 11, FIG. 10 is a schematic diagram of a liquid crystal display 200 with the gamma-voltage generator 100 that operates within a first frame period in accordance with an embodiment of the invention. FIG. 11 is a schematic diagram of the liquid crystal display 200 during a second frame period. The liquid crystal display 200 has the gamma-voltage generator 100, a source driver 202, and a plurality of lines of pixels 226(1)-226(*n*). The source driver 202 receives the gamma voltages V1 to V18 from the gamma-voltage generator 100, and is configured to output gamma voltages to the lines of pixels 226(1)-226(*n*) based on the received gamma voltages V1 to V18, so as to drive the liquid crystal molecules in the pixels to rotate. The source driver 202 has a plurality of DACs 220(1)-220(*n*), a plurality of third switching circuits 222(1)-222(*m*), and a plurality of operational amplifiers 224(1)-224(*n*).

For ease of description, in the embodiment, all the odd-numbered DACs 220(1), . . . , 220(*n*−3), and 220(*n*−1) of the DACs 220(1)-220(*n*) are referred to as the third DACs, and all the even-numbered DACs 220(2), . . . , 220(*n*−2), and 220(*n*) of the DACs 220(1)-220(*n*) are referred to as the fourth DACs. Moreover, all the odd-numbered operational amplifiers 224(1), . . . , 224(*n*−3) and 224(*n*−1) of the operational amplifiers 224(1)-224(*n*) are referred to as the first operational amplifiers, and all the even-numbered operational amplifiers 224(2), . . . , 224(*n*−2), and 224(*n*) of the operational amplifiers 224(1)-224(*n*) are referred to as the second operational amplifiers. The odd-numbered lines of pixels in the lines of pixels 226(1)-226(*n*) are referred to as the first pixels, and the even-numbered lines of pixels in the lines of pixels 226(1)-226(*n*) are referred to as the second pixels.

The DACs 220(1)-220(*n*) are coupled to the gamma-voltage generator 100. Whether during the first or second frame period of the liquid crystal display 200, each of the third DACs 220(1), . . . , 220(*n*−3) and 220(*n*−1) generates and outputs a corresponding third gamma voltage based on one or more of the first gamma voltages V18 to V10 received from the gamma-voltage generator 100. Similarly, each of the fourth DACs 220(2), . . . , 220(*n*−2) and 220(*n*) generates and outputs a corresponding fourth gamma voltage based on one or more of the second gamma voltages V1 to V9 received from the gamma-voltage generator 100. The polarity of the aforementioned third gamma voltages is identical with that of the first gamma voltages V18 to V10, and the polarity of the aforementioned fourth gamma voltages is identical with that of the second gamma voltages V1 to V9.

Each of the third switching circuits 222(1)-222(*m*) is coupled to a corresponding one of the third DACs 220(1), . . . , 220(*n*−3) or 220(*n*−1) and a corresponding one of the fourth DACs 220(2), . . . , 220(*n*−2) or 220(*n*). During the first frame period of the liquid crystal display 200, the third switching circuits 222(1)-222(*m*) couple the third DACs 220(1), . . . , 220(*n*−3) and 220(*n*−1) to the first operational amplifiers 224(1), . . . , 224(*n*−3) and 224(*n*−1), and couple the fourth DACs 220(2), . . . , 220(*n*−2) and 220(*n*) to the second operational amplifiers 224(2), . . . , 224(*n*−2) and 224(n).

During the second frame period of the liquid crystal display 200, the third switching circuits 222(1)-222(*m*) couple the third DACs 220(1), . . . , 220(*n*−3) and 220(*n*−1) to the second operational amplifiers 224(2), . . . , 224(*n*−2) and 224(*n*), and couple the fourth DACs 220(2), . . . , 220(*n*−2) and 220(*n*) to the first operational amplifiers 224(1), . . . , 224(*n*−3) and 224(*n*−1).

The first operational amplifiers 224(1), . . . , 224(*n*−3) and 224(*n*−1) are coupled between the third switching circuits 222(1)-222(*m*) and the first pixels 226(1), . . . , 226(*n*−3) and 226(*n*−1) of the lines of pixels of the liquid crystal display. During the first frame period of the liquid crystal display, each of the first operational amplifiers 224(1), . . . , 224(*n*−3) or 224(*n*−1) respectively amplifies and outputs the aforementioned third gamma voltage transmitted from the third DACs 220(1), . . . , 220(*n*−3) or 220(*n*−1) to the corresponding line of first pixels 226(1), . . . , 226(*n*−3) or 226(*n*−1). During the second frame period of the liquid crystal display, each of the first operational amplifiers 224(1), . . . , 224(*n*−3) or 224(*n*−1) respectively amplifies and outputs the aforementioned fourth gamma voltage transmitted from the fourth DACs 220(2), . . . , 220(*n*−2) or 220(*n*) to the corresponding line of first pixels 226(1), . . . , 226(*n*−3) or 226(*n*−1).

Similarly, the second operational amplifiers 224(2), . . . , 224(*n*−2) and 224(*n*) are coupled between the third switching circuits 222(1)-222(*m*) and the second pixels 226(2), . . . , 226(*n*−2) and 226(*n*) of the lines of pixels of the liquid crystal display 200. During the first frame period of the liquid crystal display 200, each of the second operational amplifiers 224(2), . . . , 224(*n*−2) or 224(*n*) respectively amplifies and outputs the aforementioned fourth gamma voltage transmitted from the fourth DACs 220(2), . . . , 220(*n*−2) or 220(*n*) to the corresponding line of second pixels 226(2), . . . , 226(*n*−2) or 226(*n*). During the second frame period of the liquid crystal display, each of the second operational amplifiers 224(2), . . . , 224(*n*−2) or 224(*n*) respectively amplifies and outputs the aforementioned third gamma voltage transmitted from the third DACs 220(1), . . . , 220(*n*−3) or 220(*n*−1) to the corresponding line of second pixels 226(2), . . . , 226(*n*−2) or 226(*n*).

In one embodiment of the invention, the first switching circuit 110, the second switching circuit 120, and the third switching circuits 222(1)-222(*m*) perform switching according to the first control signal S1 and the second control signal S2 depicted in FIG. 9.

As shown in FIGS. 7-8 and 10-11, whether the liquid crystal display 200 is in the first or the second frame period, the gamma voltages transmitted to the first pixels 226(1), . . . , 226(*n*−3) and 226(*n*−1) are buffered by the first gamma buffer 104(1), 104(3), . . . , 104(15), and 104(17), and the gamma voltages transmitted to the second pixels 226(2), . . . , 226(*n*−2) and 226(*n*) are buffered by the second gamma buffer 104(2), 104(4), . . . , 104(16), and 104(18). Therefore, during the first or the second frame period, the gamma voltages received by pixels of a same line have been buffered by the same gamma buffer. Consequently, the display quality of the liquid crystal display 200 can approach an optimal condition.

Figure 1:
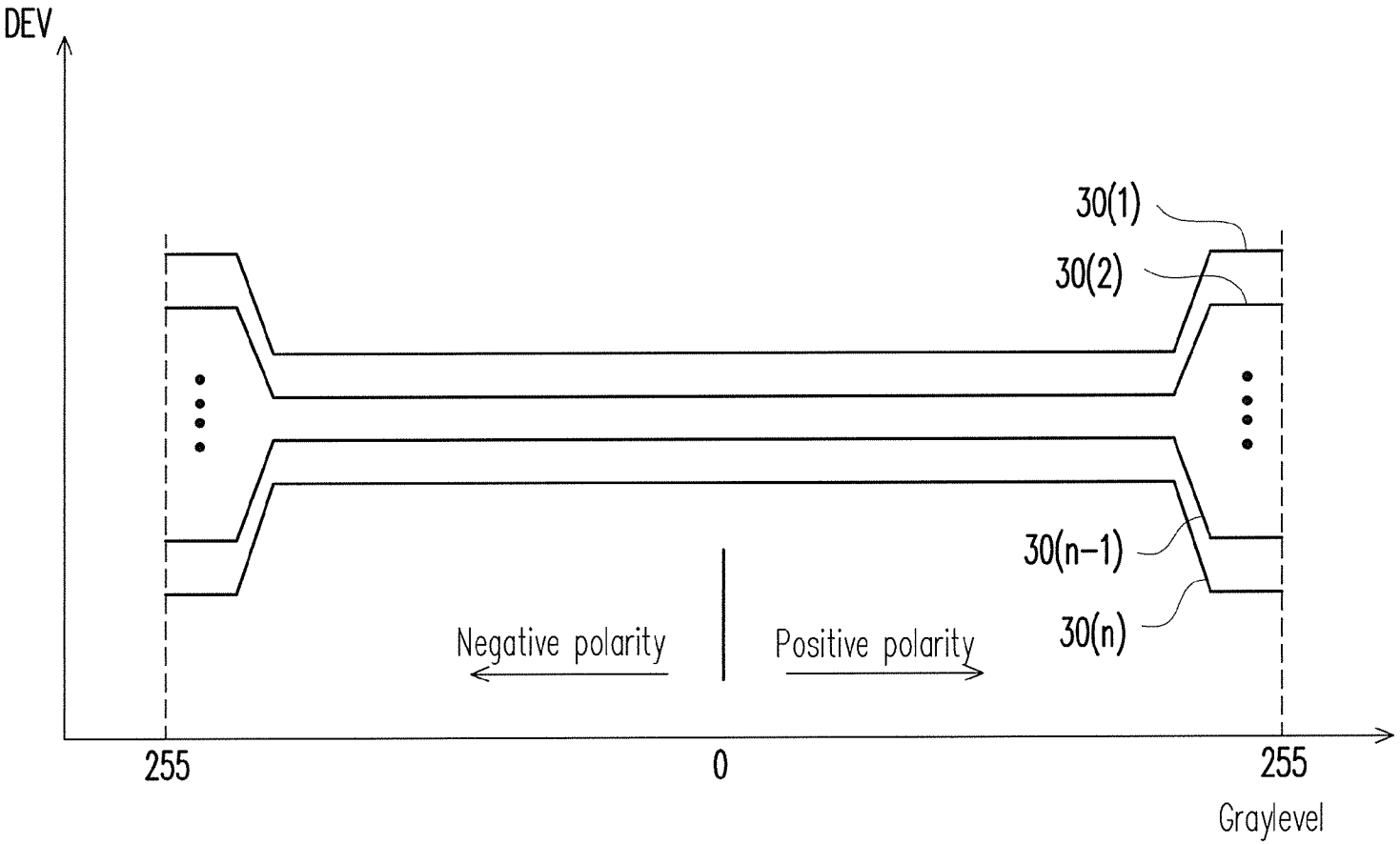
FIG. 1 (RELATED ART)
FIG. 1 is a diagram illustrating relationships between a DEV voltage of a driving circuit using an idealized gamma buffer and each graylevel.
Figure 5:
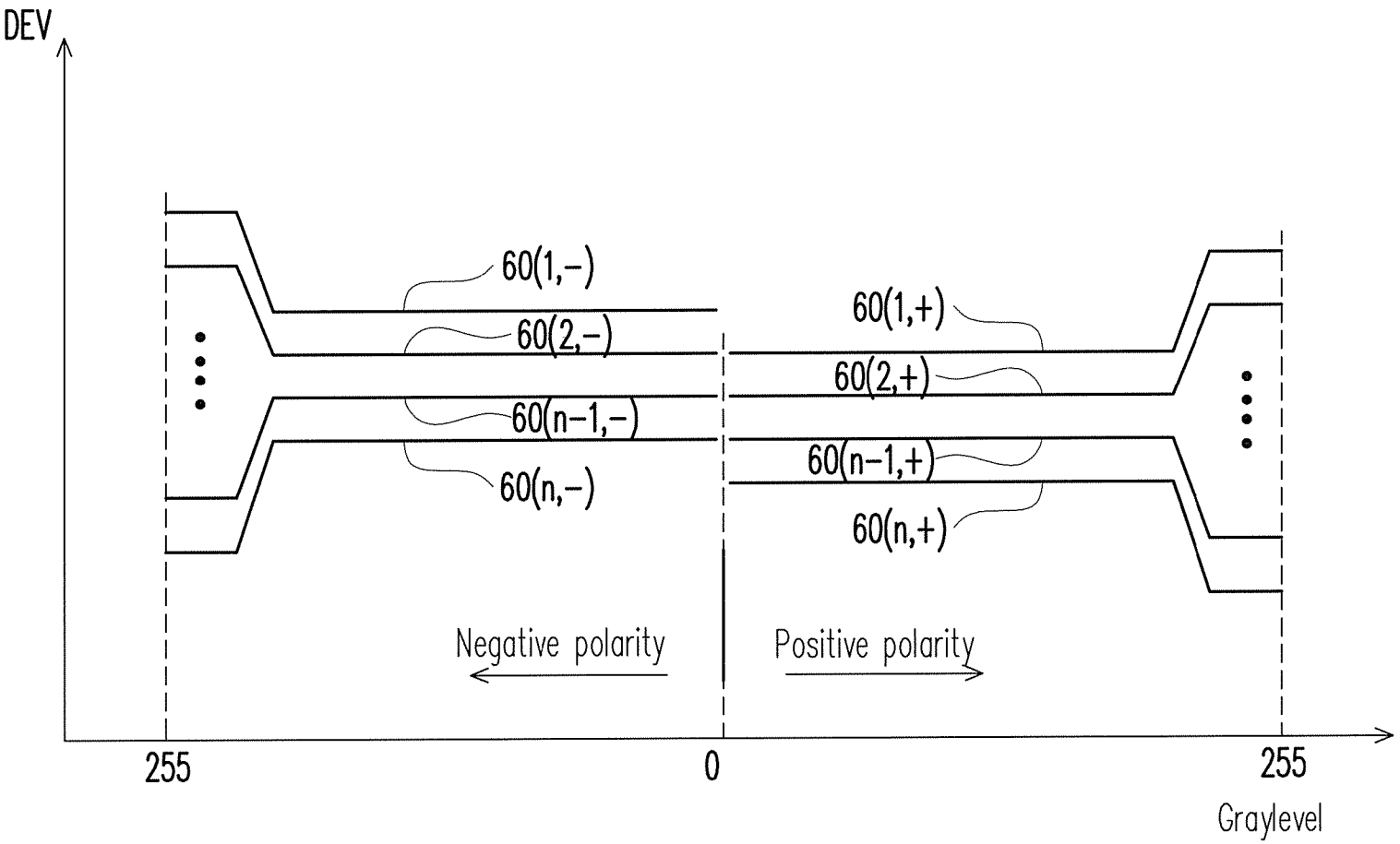
FIG. 5 (RELATED ART)
FIG. 5 is a diagram illustrating relationships between the DEV voltage of the driving circuit depicted in FIG. 3 and each graylevel.
Figure 12:
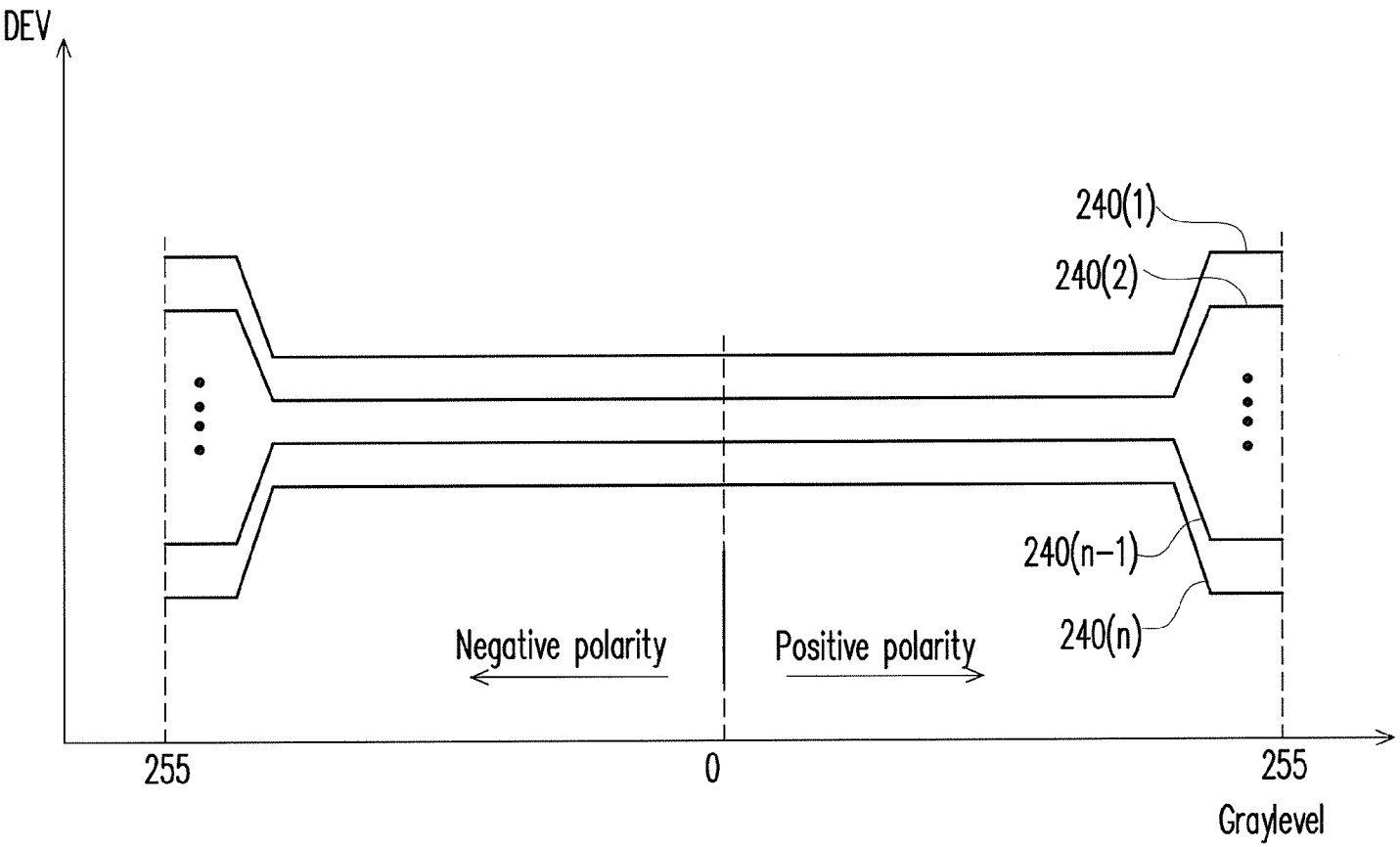
FIG. 12 is a diagram illustrating relationships between a DEV voltage of the driving circuit depicted in FIGS. 10 and 11 and each graylevel.

Referring to FIG. 12, FIG. 12 is a diagram illustrating relationships between the DEV voltage of the pixels 226(1)-226(*n*) and each graylevel. The DEV voltage is defined as a difference value obtained by subtracting the gamma voltage the liquid crystal display 200 outputs to the pixels 226(1)-226(*n*) by a predetermined idealized voltage. Each of the curves 240(1)-240(*n*) depicted in FIG. 12 respectively corresponds to a line of pixels 226(1), 226(2), . . . , 226(*n*−3), 226(*n*−2), 226(*n*−1) or 226(*n*). Compared to the curves depicted in FIG. 5, the curves depicted in FIG. 12 more closely resemble the idealized curves depicted in FIG. 1.

Figure 2:
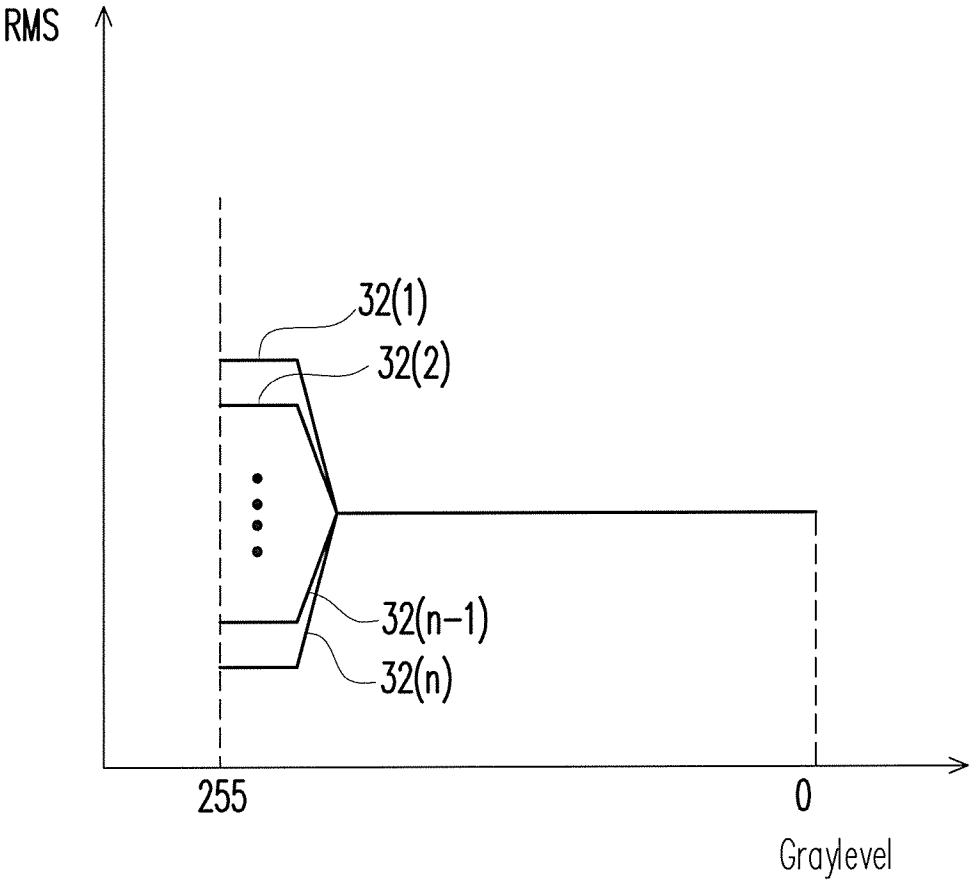
FIG. 2 (RELATED ART)
FIG. 2 is a diagram illustrating relationships between a root mean square (RMS) of a driving circuit using an idealized gamma buffer and each graylevel.
Figure 3:
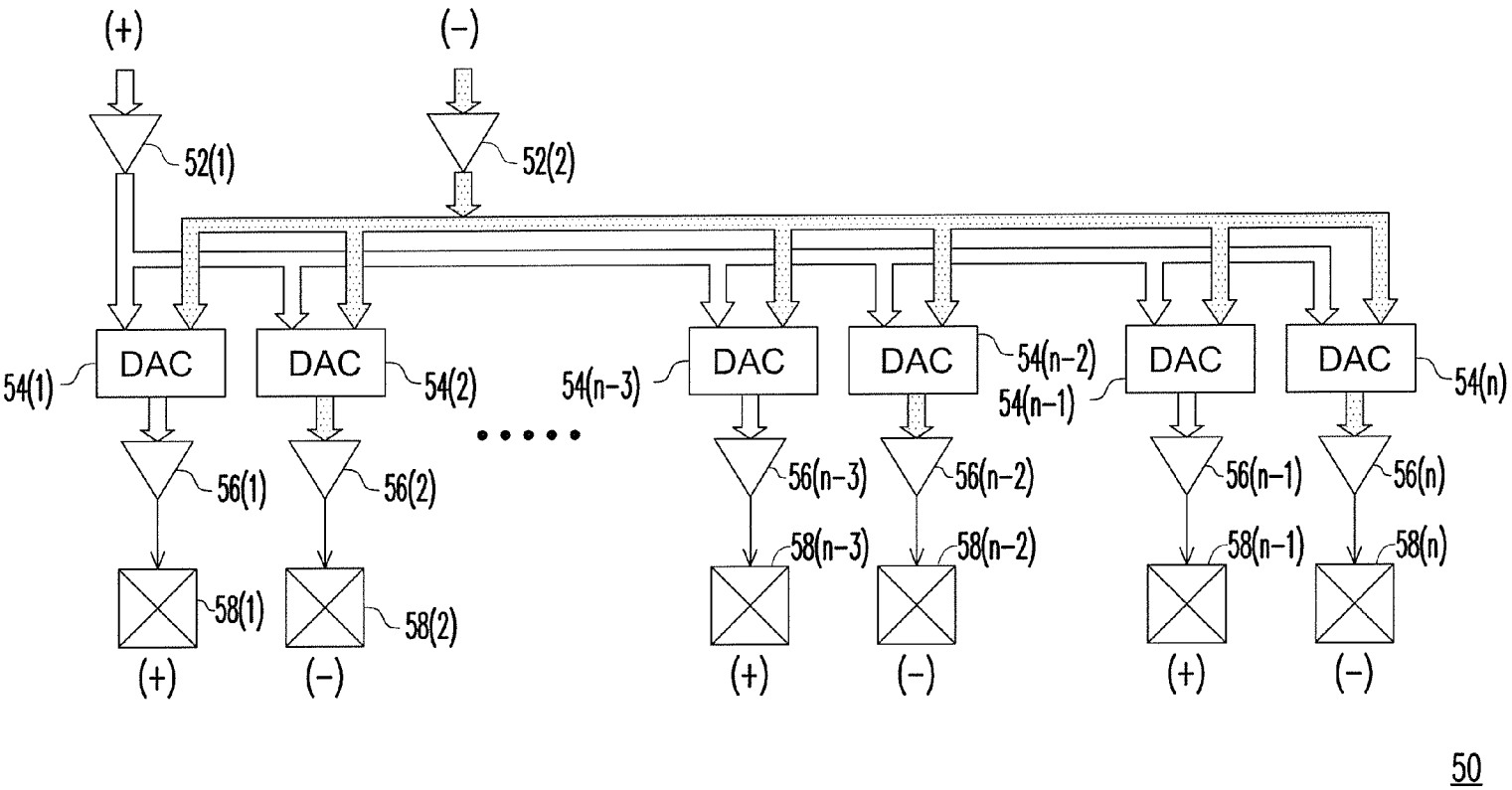
FIG. 3 (RELATED ART)
FIG. 3 is a schematic diagram of a driving circuit of a conventional liquid crystal display during a first frame period.
Figure 4:
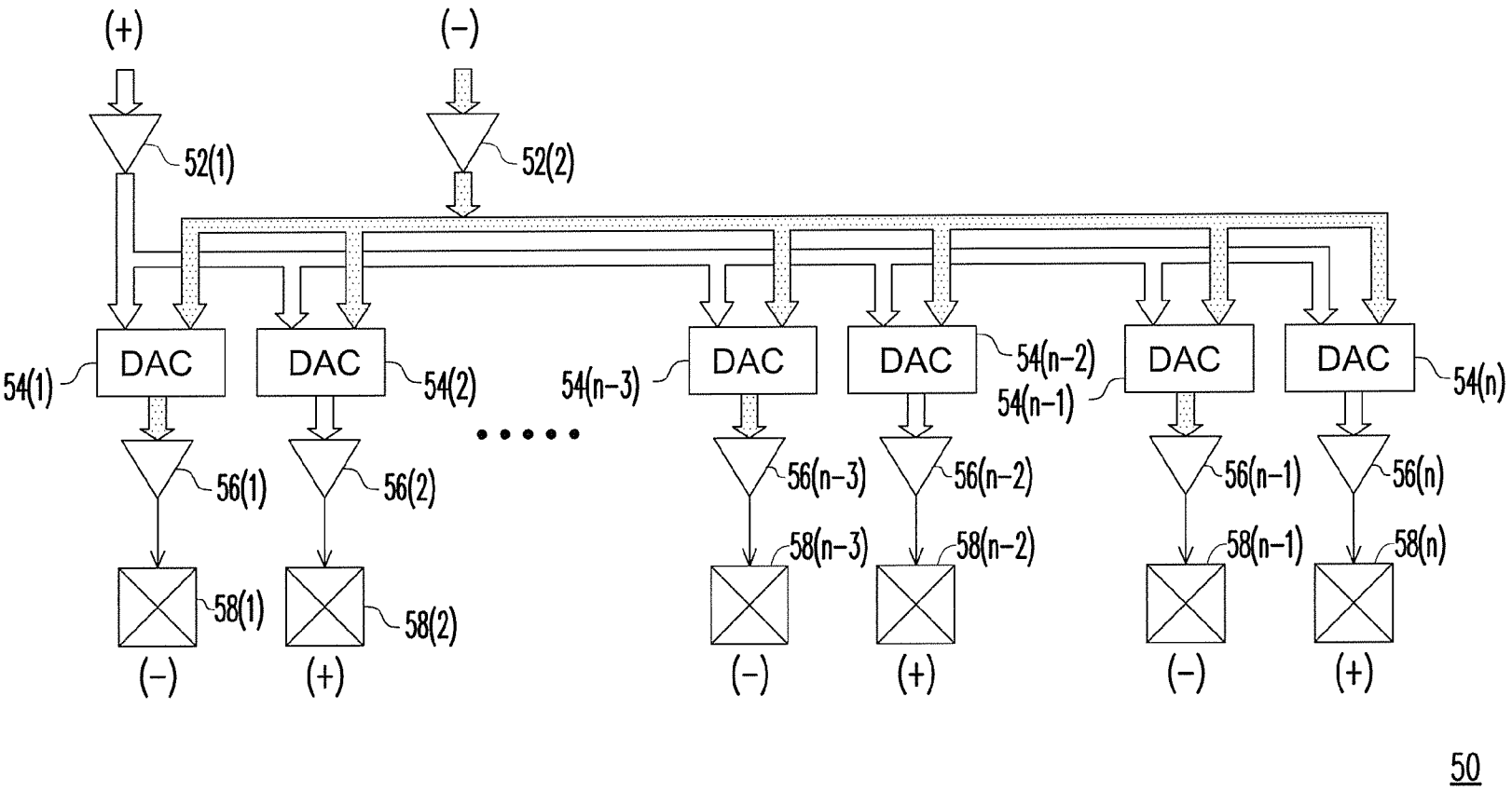
FIG. 4 (RELATED ART)
FIG. 4 is a schematic diagram of the driving circuit depicted in FIG. 3 during a second frame period.
Figure 6:
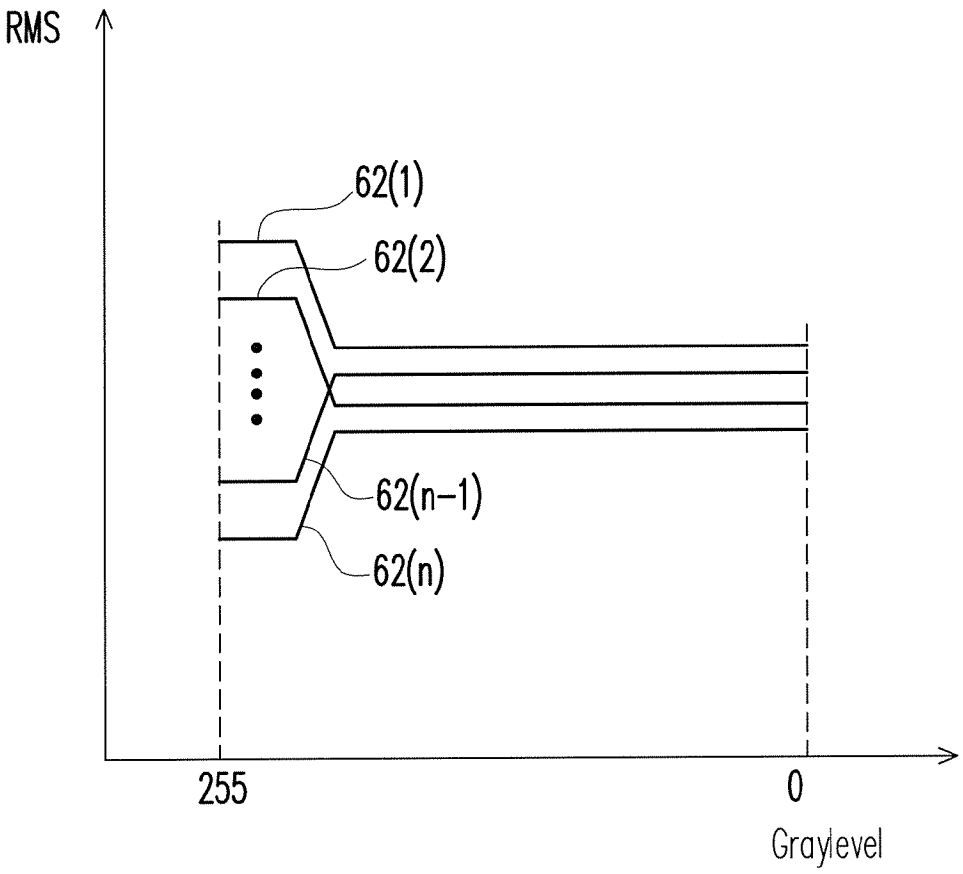
FIG. 6 (RELATED ART)
FIG. 6 is a diagram illustrating relationships between the RMS of the driving circuit depicted in FIG. 3 and each graylevel.
Figure 13:
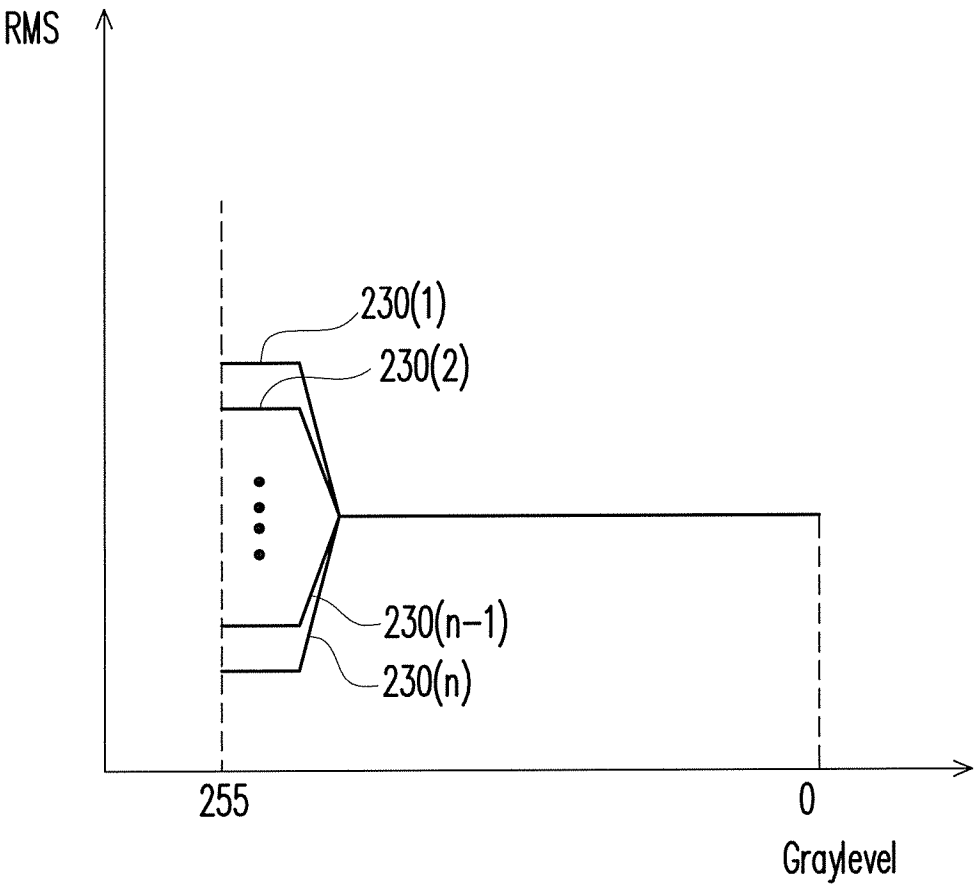
FIG. 13 is a diagram illustrating relationships between the RMS of the driving circuit depicted in FIGS. 10 and 11 and each graylevel.

Moreover, referring to FIG. 13, FIG. 13 is a diagram illustrating relationships between the RMS of the liquid crystal display 200 and each graylevel. Each of a plurality of curves 230(1)-230(*n*) respectively corresponds to a line of the lines of pixels 226(1)-226(*n*). Compared to the curves depicted in FIG. 6, the curves depicted in FIG. 13 more closely resemble the idealized curves depicted in FIG. 2.

Referring to FIGS. 7 and 8 again, the first gamma buffers 104(1), 104(3), . . . , 104(15), and 104(17) buffer the first gamma voltages V18 to V10 within the first frame period and buffer the second gamma voltages V1 to V9 within the second frame period. The second gamma buffers 104(2), 104(4), . . . , 104(16), and 104(18) buffer the second gamma voltages V1 to V9 within the first frame period and buffer the first gamma voltages V18 to V10 within the second frame period. Accordingly, at least one of the first gamma voltages V18 to V10 generated by the first DACs 102(1), 102(3), . . . , 102(15), and 102(17) within the first frame period and at least one of the second gamma voltages V1 to V9 generated by the second DACs 102(2), 102(4), . . . , 102(16), and 102(18) within the second frame period are outputted from a same one of the first gamma buffers 104(1), 104(3), . . . , 104(15), and 104(17). For example, the first gamma voltage V18 generated by the first DAC 102(1) within the first frame period and the second voltage V1 generated by the second DAC 102(2) within the second frame period are outputted from the first gamma buffer 104(1). Similarly, at least one of the second gamma voltages V1 to V9 generated by the second DACs 102(2), 102(4), . . . , 102(16), and 102(18) within the first frame period and at least one of the first gamma voltages V18 to V10 generated by the first DACs 102(1), 102(3), . . . , 102(15), and 102(17) within the second frame period are outputted from a same one of the second gamma buffers 104(2), 104(4), . . . , 104(16), and 104(18). For example, the second gamma voltage V1 generated by the first DAC 102(2) within the first frame period and the second voltage V18 generated by the first DAC 102(1) within the second frame period are outputted from the second gamma buffer 104(2).

Figure 14:
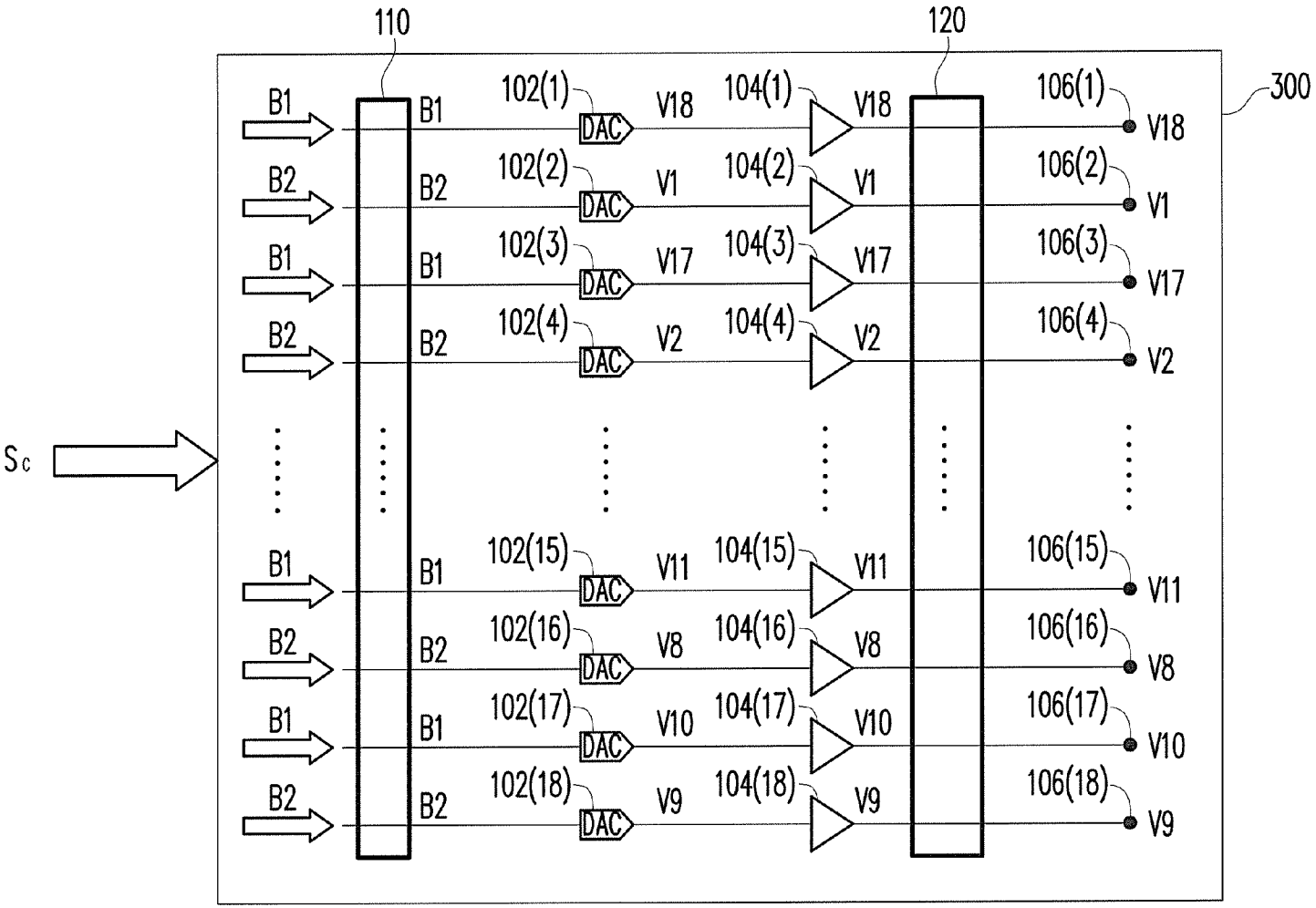
FIG. 14 is a schematic diagram of a gamma-voltage generator during a first frame period in accordance with an embodiment of the invention.
Figure 15:
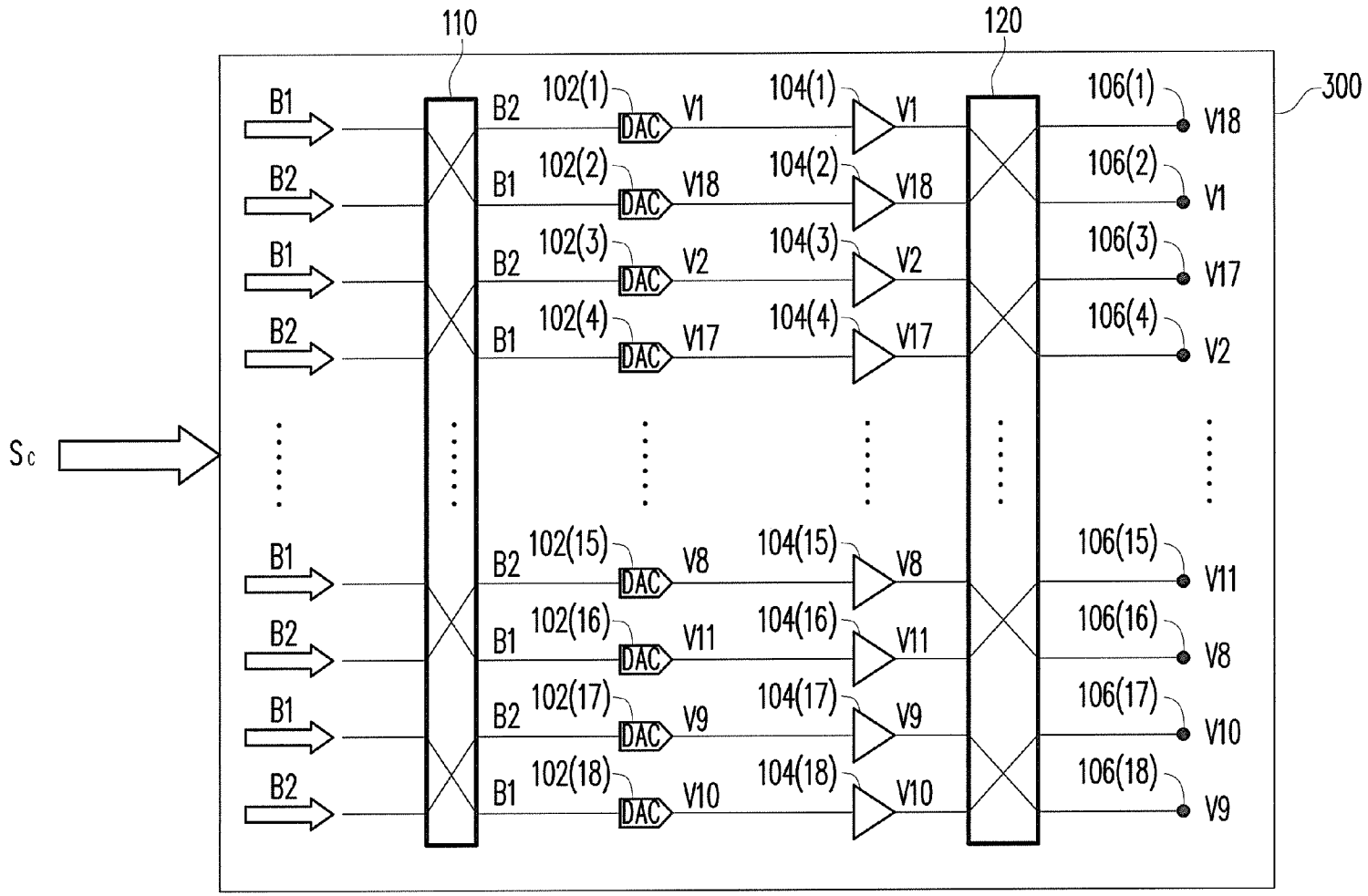
FIG. 15 is a schematic diagram of the gamma-voltage generator depicted in FIG. 14 during a second frame period.

Referring to FIGS. 14 and 15, FIG. 14 is a schematic diagram of a gamma-voltage generator 300 during a first frame period in accordance with an embodiment of the invention. FIG. 15 is a schematic diagram of the gamma-voltage generator 300 during a second frame period. The gamma-voltage generator 300 also has the DACs 102(1)-102(18), the gamma buffers 104(1)-104(18), the terminals 106(1)-106(18), the first switching circuit 110 and the second switching circuit 120. In the embodiment, the first switching circuit 110 is coupled to the DACs 102(1)-102(18) and receives the digital signal $S_C$. The second switching circuit 120 is coupled between the gamma buffers 104(1)-104(18) and the terminals 106(1)-106(18). During the first frame period, the first switching circuit 110 transmits the first bits B1 of the digital signal $S_C$ to the first DACs 102(1), 102(3), . . . , 102(15), and 102(17) and transmits the second bits B2 of the digital signal $S_C$ to the second DACs 102(2), 102(4), . . . , 102(16), and 102(18), and the second switching circuit 120 connects the first gamma buffers 104(1), 104(3), . . . , 104(15), and 104(17) to the first terminals 106(1), 106(3), . . . , 106(15), and 106(17) and connects the second gamma buffers 104(2), 104(4), . . . , 104(16), and 104(18) to the second terminals 106(2), 106(4), . . . , 106(16), and 106(18).

During the second frame period, the first switching circuit 110 transmits the first bits B1 of the digital signal $S_C$ to the second DACs 102(2), 102(4), . . . , 102(16), and 102(18) and transmits the second bits B2 of the digital signal $S_C$ to the first DACs 102(1), 102(3), . . . , 102(15), and 102(17), and the second switching circuit 120 connects the first gamma buffers 104(1), 104(3), . . . , 104(15), and 104(17) to the second terminals 106(2), 106(4), . . . , 106(16), and 106(18) and connects the second gamma buffers 104(2), 104(4), . . . , 104(16), and 104(18) to the first terminals 106(1), 106(3), . . . , 106(15), and 106(17).

Figure 16:
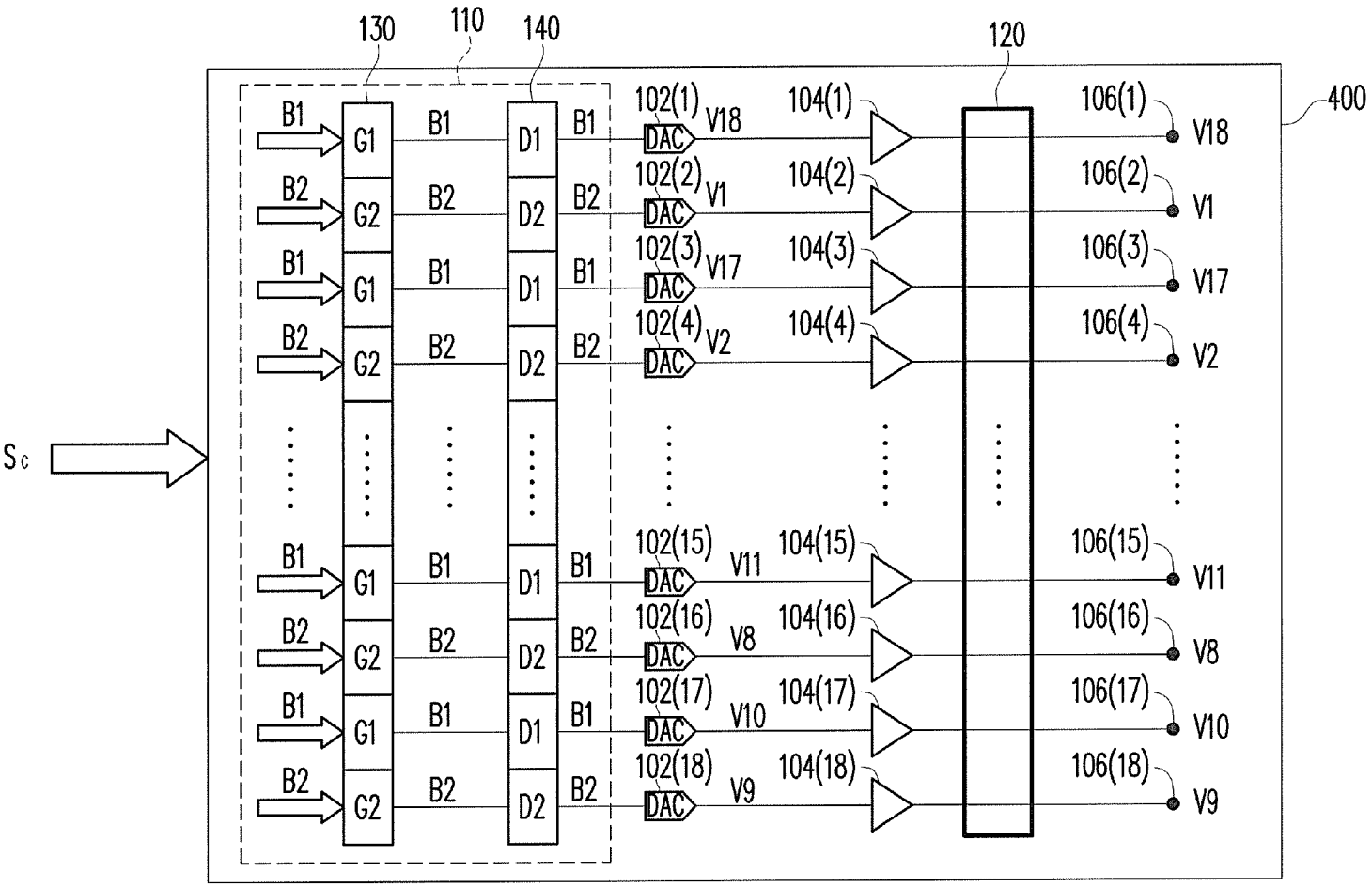
FIG. 16 is a schematic diagram of a gamma-voltage generator during a first frame period in accordance with an embodiment of the invention.
Figure 17:
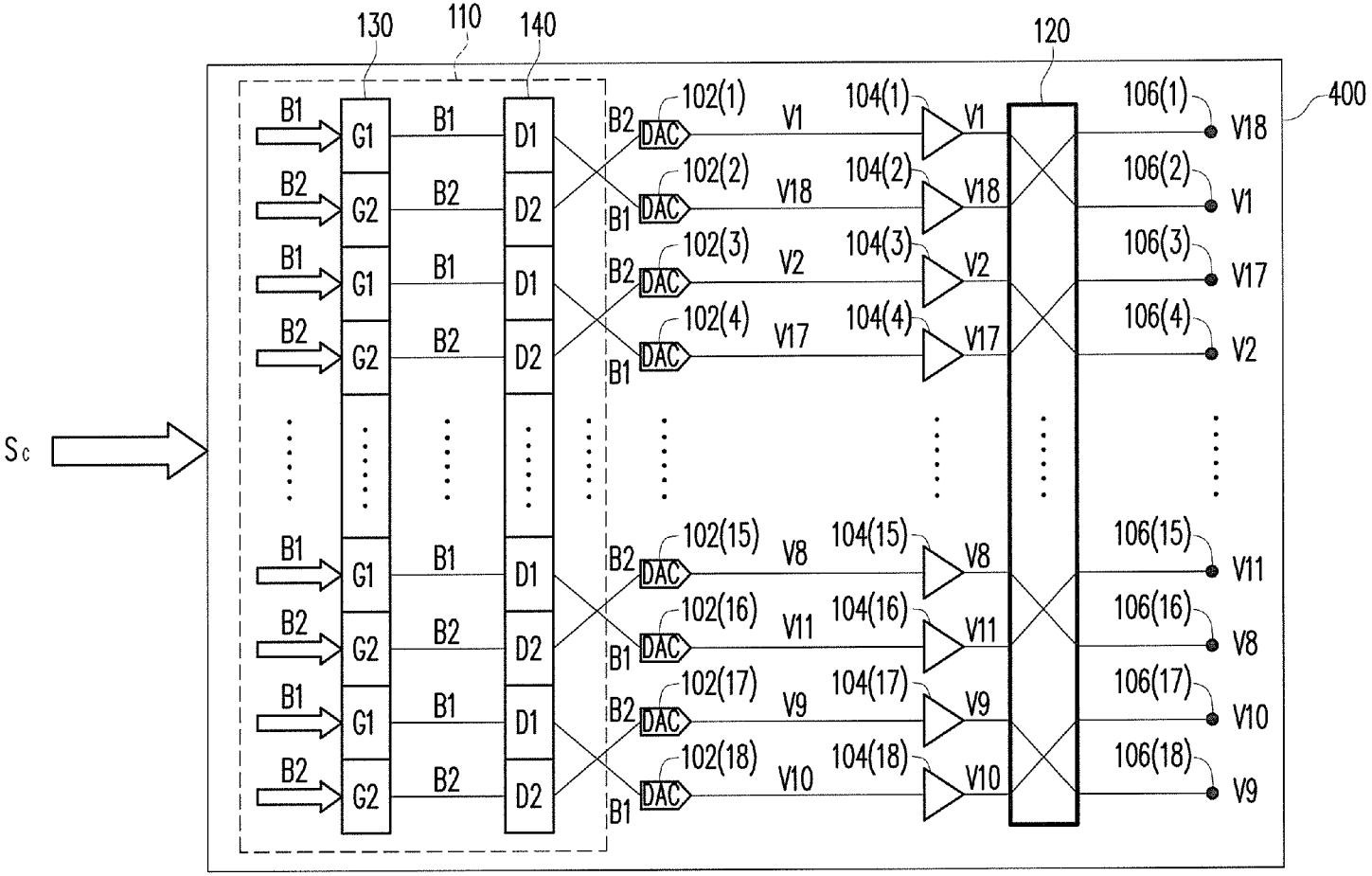
FIG. 17 is a schematic diagram of the gamma-voltage generator depicted in FIG. 16 during a second frame period.

Referring to FIGS. 16 and 17, FIG. 16 is a schematic diagram of a gamma-voltage generator 400 during a first frame period in accordance with an embodiment of the invention. FIG. 17 is a schematic diagram of the gamma-voltage generator 400 during a second frame period. The gamma-voltage generator 400 also has the DACs 102(1)-102(18), the gamma buffers 104(1)-104(18), the terminals 106(1)-106(18), the first switching circuit 110 and the second switching circuit 120. In the embodiment, the first switching circuit 110 has a first register 130 and a second register 140. The first register 130 has a plurality of first sections G1 and a plurality of second sections G2. The first sections G1 of the first register 130 temporarily store the first bits B1 of the digital signal $S_C$, and the second sections G2 of the first register 130 temporarily store the second bits B2 of the digital signal $S_C$. The second register 140 has a plurality of first sections D1 and a plurality of second sections D2. Each of the first sections D1 of the second register 140 is coupled to a corresponding one of the first sections G1 of the first register 130 to receive the first bits B1, and each of the second sections D2 of the second register 140 is coupled to a corresponding one of the second sections G2 of the first register 130 to receive the second bits B2. During the first frame period, the first sections D1 of the second register 140 transmits the first bits B1 of the digital signal $S_C$ to the first DACs 102(1), 102(3), . . . , 102(15), and 102(17), and the second sections D2 of the second register 140 transmits the second bits B2 of the digital signal $S_C$ to the second DACs 102(2), 102(4), . . . , 102(16), and 102(18). Moreover, during the first frame period, the second switching circuit 120 connects the first gamma buffers 104(1), 104(3), . . . , 104(15), and 104(17) to the first terminals 106(1), 106(3), . . . , 106(15), and 106(17) and connects the second gamma buffers 104(2), 104(4), . . . , 104(16), and 104(18) to the second terminals 106(2), 106(4), . . . , 106(16), and 106(18).

During the second frame period, the first sections D1 of the second register 140 transmits the first bits B1 of the digital signal $S_C$ to the second DACs 102(2), 102(4), . . . , 102(16), and 102(18), and the second sections D2 of the second register 140 transmits the second bits B2 of the digital signal $S_C$ to the first DACs 102(1), 102(3), . . . , 102(15), and 102(17). Moreover, during the second frame period, the second switching circuit 120 connects the first gamma buffers 104(1), 104(3), . . . , 104(15), and 104(17) to the second terminals 106(2), 106(4), . . . , 106(16), and 106(18) and connects the second gamma buffers 104(2), 104(4), . . . , 104(16), and 104(18) to the first terminals 106(1), 106(3), . . . , 106(15), and 106(17).

Figure 18:
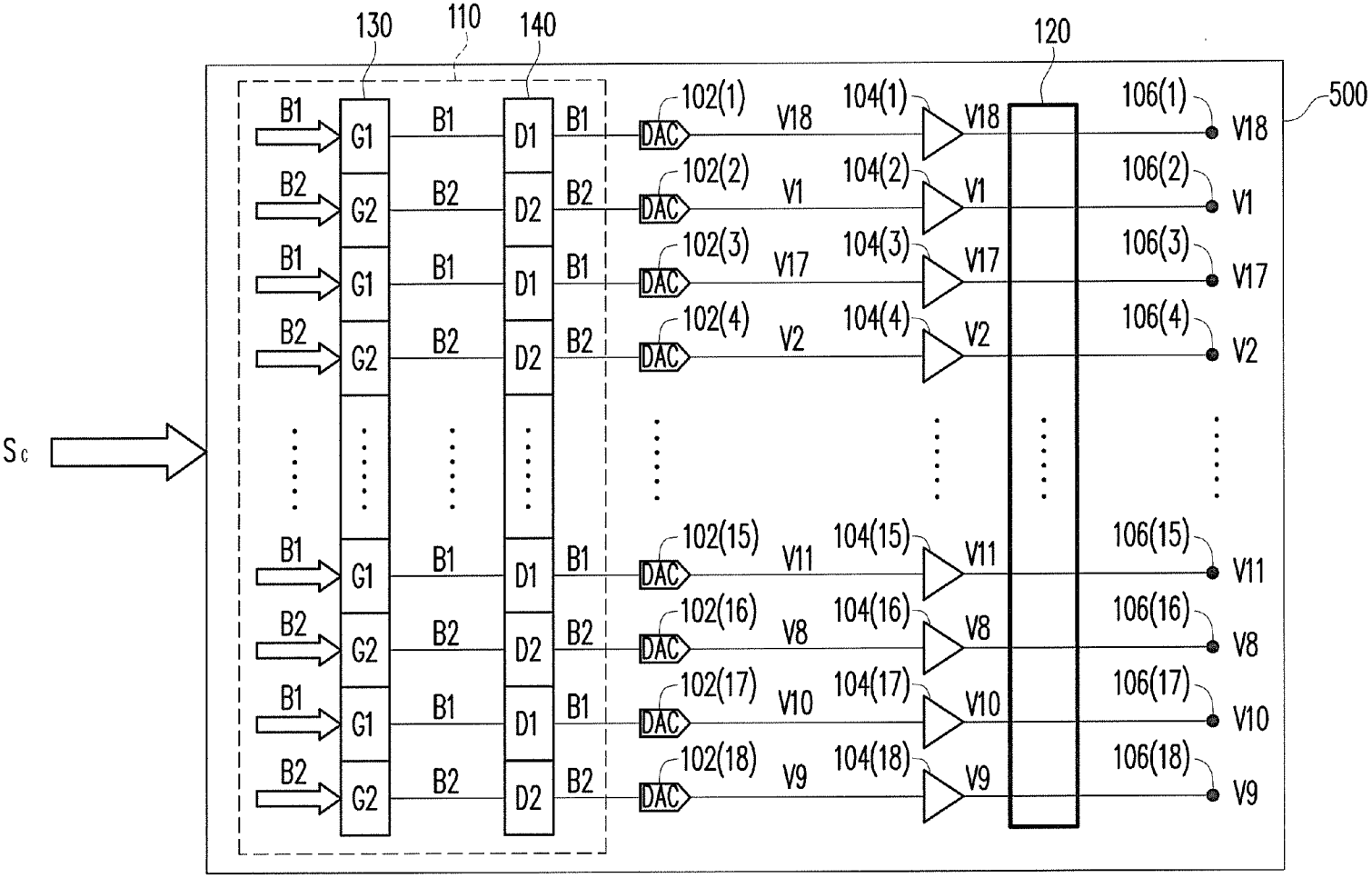
FIG. 18 is a schematic diagram of a gamma-voltage generator during a first frame period in accordance with an embodiment of the invention.
Figure 19:
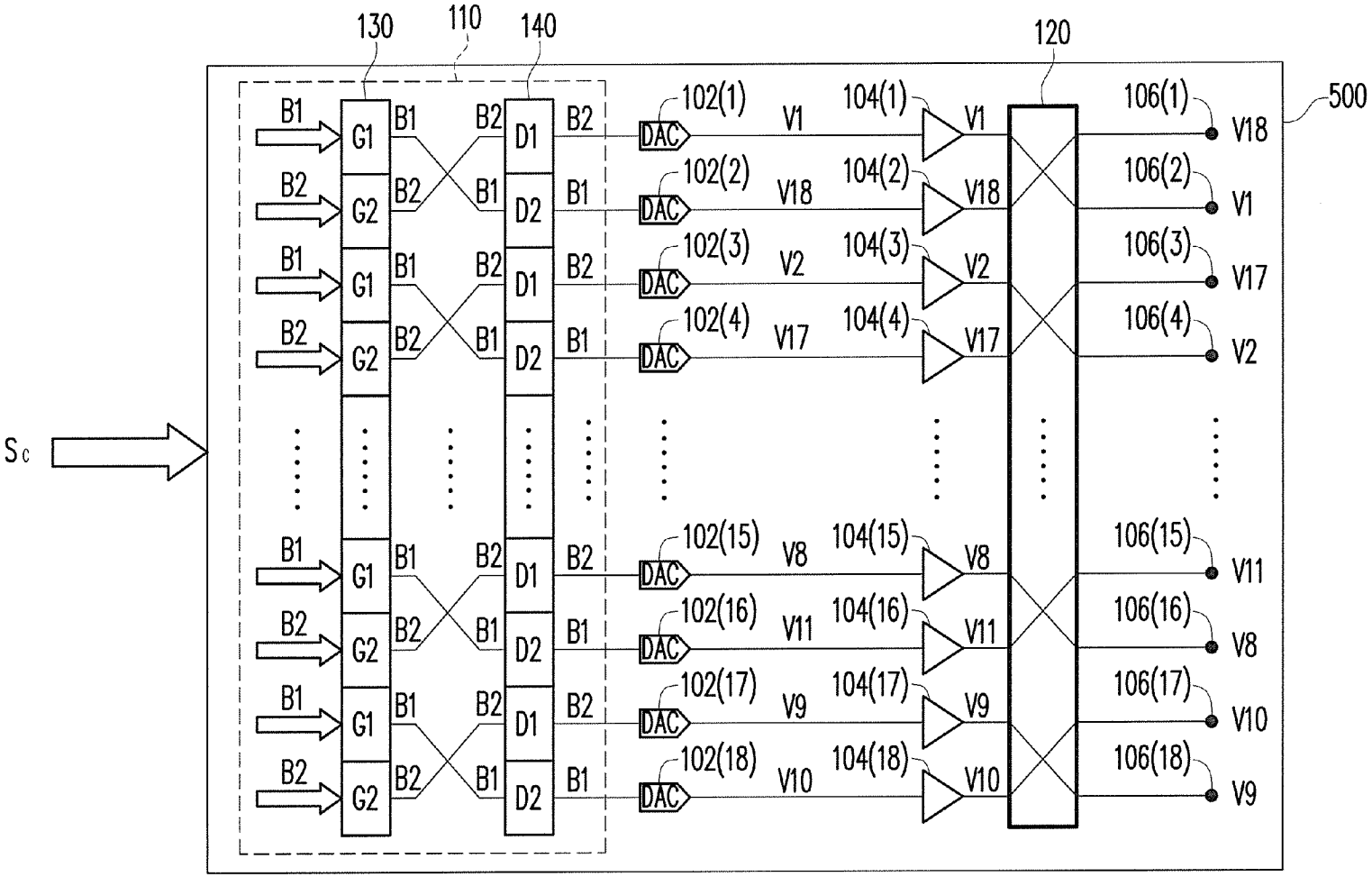
FIG. 19 is a schematic diagram of the gamma-voltage generator depicted in FIG. 18 during a second frame period.

Referring to FIGS. 18 and 19, FIG. 18 is a schematic diagram of a gamma-voltage generator 500 during a first frame period in accordance with an embodiment of the invention. FIG. 19 is a schematic diagram of the gamma-voltage generator 500 during a second frame period. The gamma-voltage generator 500 also has the DACs 102(1)-102(18), the gamma buffers 104(1)-104(18), the terminals 106(1)-106(18), the first switching circuit 110 and the second switching circuit 120. The first switching circuit 110 has a first register 130 and a second register 140. During the first frame period, the first sections G1 of the first register 130 transmits the first bits B1 of the digital signal $S_C$ to the first sections D1 of the second register 140, and the second sections G2 of the first register 130 transmits the second bits B2 of the digital signal $S_C$ to the second sections D2 of the second register 140. Moreover, during the first frame period, the second switching circuit 120 connects the first gamma buffers 104(1), 104(3), . . . , 104(15), and 104(17) to the first terminals 106(1), 106(3), . . . , 106(15), and 106(17) and connects the second gamma buffers 104(2), 104(4), . . . , 104(16), and 104(18) to the second terminals 106(2), 106(4), . . . , 106(16), and 106(18).

During the second frame period, the first sections G1 of the first register 130 transmits the first bits B1 of the digital signal $S_C$ to the second sections D2 of the second register 140, and the second sections G2 of the first register 130 transmits the second bits B2 of the digital signal $S_C$ to the first sections D1 of the second register 140. Moreover, during the second frame period, the second switching circuit 120 connects the first gamma buffers 104(1), 104(3), . . . , 104(15), and 104(17) to the second terminals 106(2), 106(4), . . . , 106(16), and 106(18) and connects the second gamma buffers 104(2), 104(4), . . . , 104(16), and 104(18) to the first terminals 106(1), 106(3), . . . , 106(15), and 106(17).

Figure 20:
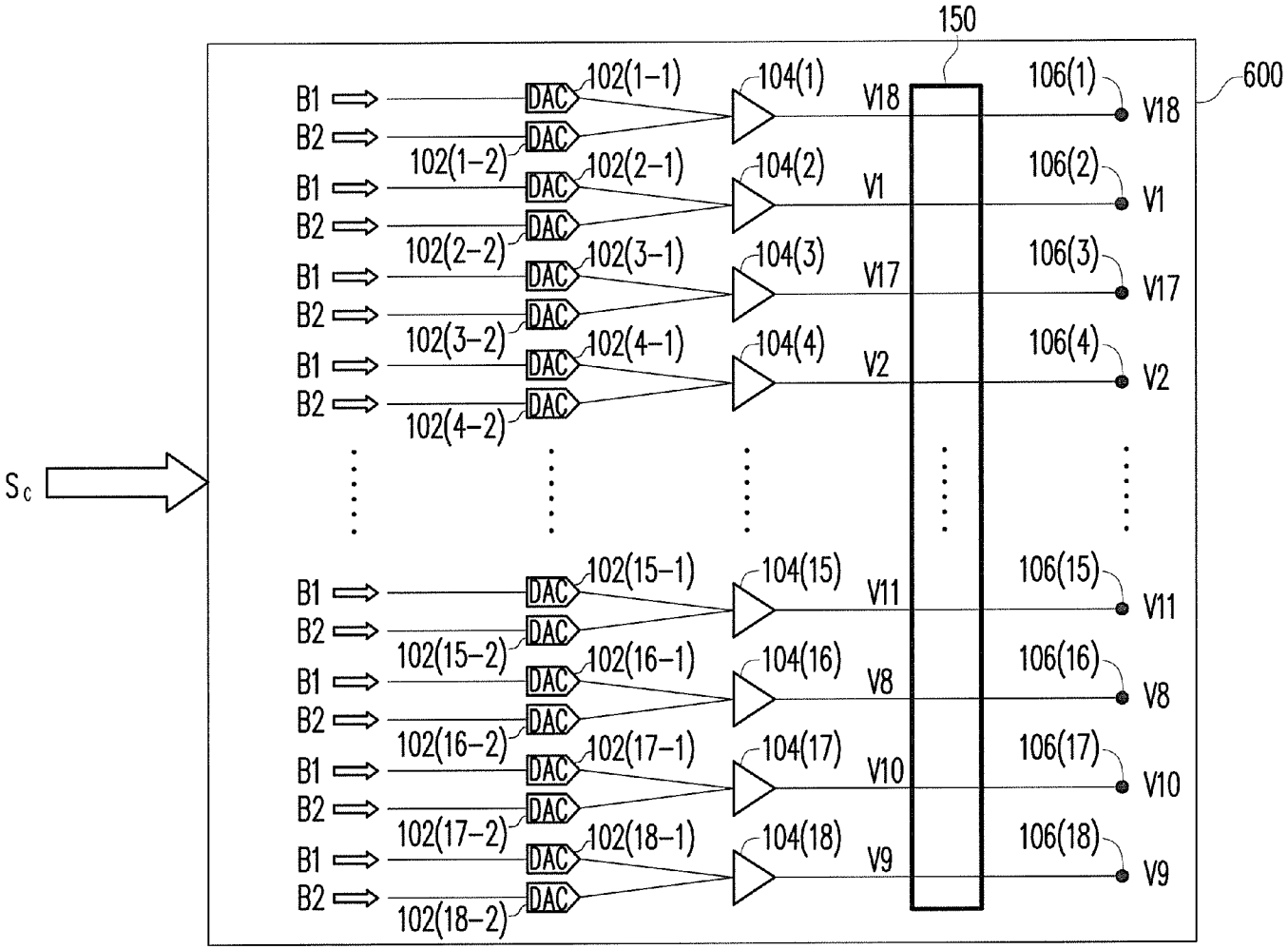
FIG. 20 is a schematic diagram of a gamma-voltage generator during a first frame period in accordance with an embodiment of the invention.
Figure 21:
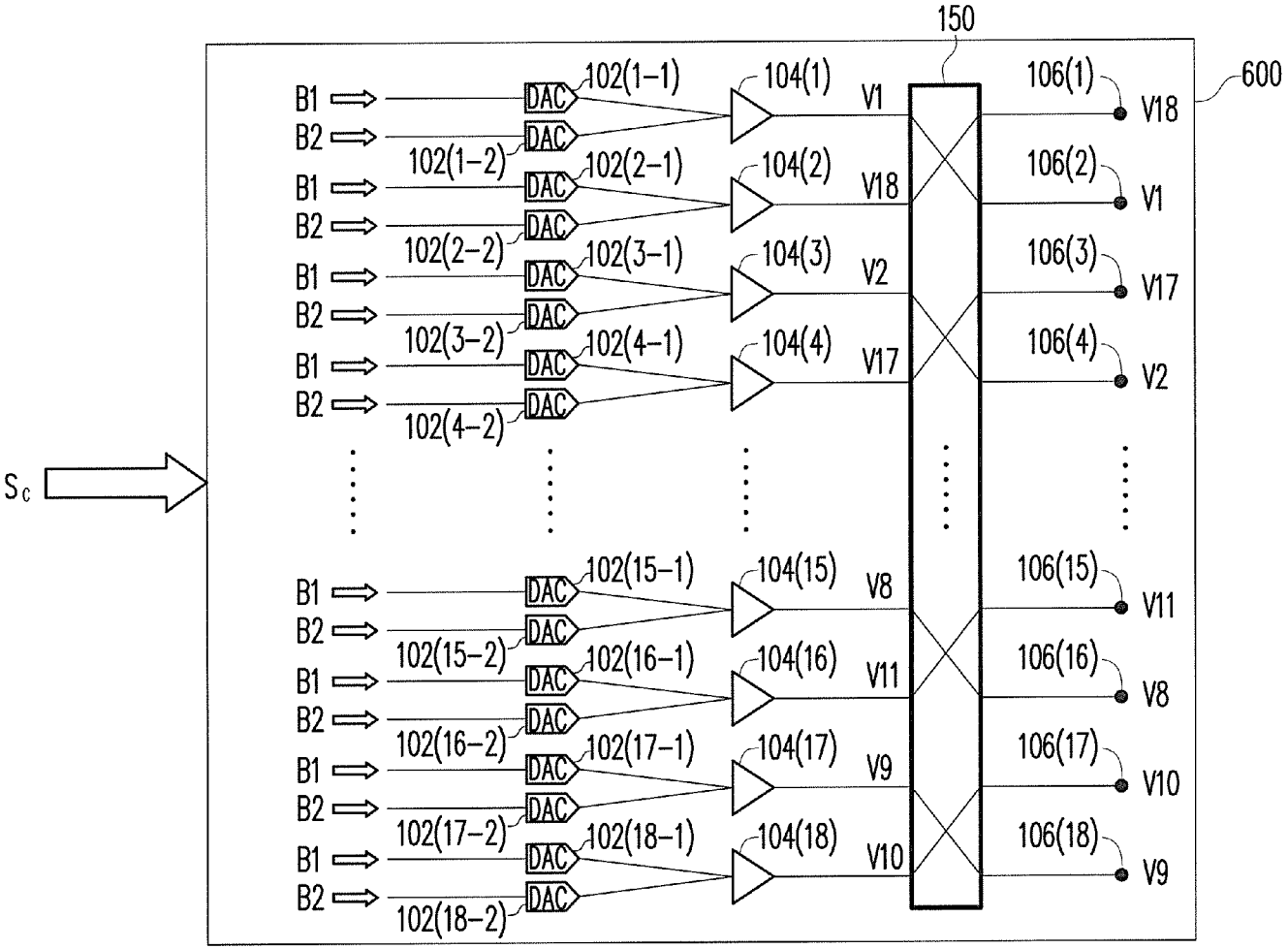
FIG. 21 is a schematic diagram of the gamma-voltage generator depicted in FIG. 20 during a second frame period.

Referring to FIGS. 20 and 21, FIG. 20 is a schematic diagram of a gamma-voltage generator 600 during a first frame period in accordance with an embodiment of the invention. FIG. 21 is a schematic diagram of the gamma-voltage generator 600 during a second frame period. The gamma-voltage generator 600 also has a plurality of first DACs 102(1-1)-102(18-1), a plurality of second DACs 102(1-2)-102(18-2), the gamma buffers 104(1)-104(18), the terminals 106(1)-106(18), and a switching circuit 150. The switching circuit 150 is coupled between the gamma buffers 104(1)-104(18) and the terminals 106(1)-106(18). The first DACs 102(1-1)-102(18-1) generate the first gamma voltages V18 to V10 according to the first bits B1 of the digital signal $S_C$, and the second DACs 102(1-2)-102(18-2) generate the second gamma voltages V1 to V9 according to the second bits B2 of the digital signal $S_C$. Each of the gamma buffers 104(1)-104(18) is coupled to a corresponding one of the first DACs 102(1-1)-102(18-1) and a corresponding one of the second DACs 102(1-2)-102(18-2). Within the first frame period, the first gamma buffers 104(1), 104(3), . . . , 104(15), and 104(17) receive the first gamma voltages V18 to V10 from the corresponding first DACs 102(1-1)-102(18-1), the second gamma buffers 104(2), 104(4), . . . , 104(16), and 104(18) receive the second gamma voltages V1 to V9 from the corresponding second DACs 102(1-2)-102(18-2), and the switching circuit 150 connects the first gamma buffers 104(1), 104(3), . . . , 104(15), and 104(17) to the first terminals 106(1), 106(3), . . . , 106(15), and 106(17) and connects the second gamma buffers 104(2), 104(4), . . . , 104(16), and 104(18) to the second terminals 106(2), 106(4), . . . , 106(16), and 106(18). Within the second frame period, the first gamma buffers 104(1), 104(3), . . . , 104(15), and 104(17) receive the second gamma voltages V1 to V9 from the corresponding second DACs 102(1-2)-102(18-2), the second gamma buffers 104(2), 104(4), . . . , 104(16), and 104(18) receive the first gamma voltages V18 to V10 from the corresponding first DACs 102(1-1)-102(18-1), and the switching circuit 150 connects the first gamma buffers 104(1), 104(3), . . . , 104(15), and 104(17) to the second terminals 106(2), 106(4), . . . , 106(16), and 106(18) and connects the second gamma buffers 104(2), 104(4), . . . , 104(16), and 104(18) to the first terminals 106(1), 106(3), . . . , 106(15), and 106(17).

Figure 22:
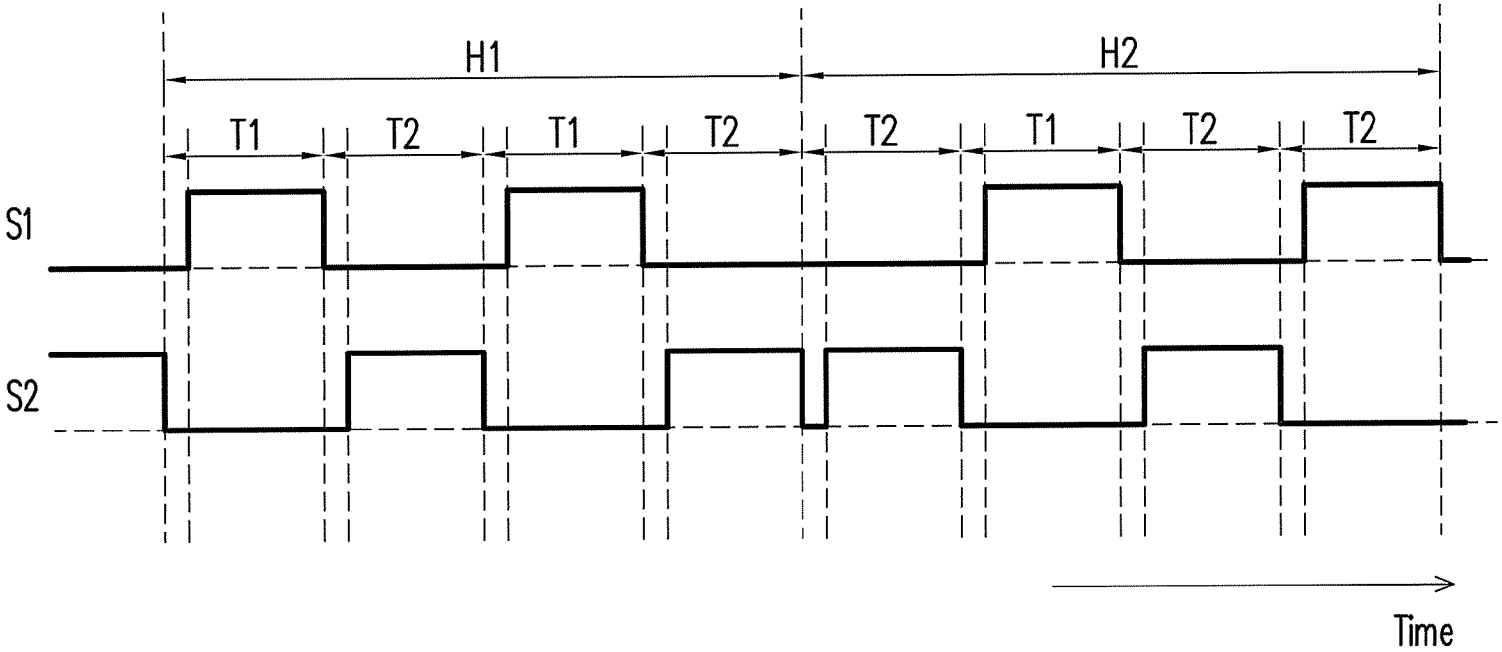
FIG. 22 is a timing diagram of the first control signal S1 and the second control signal S2 according to another embodiment of the invention.

Referring to FIG. 9, all of the first frame periods T1 are interleaved with the second frame periods T2. However, the invention is not limited thereto. Please refer to FIG. 22. FIG. 22 is a timing diagram of the first control signal S1 and the second control signal S2 according to another embodiment of the invention. The first frame periods T1 and the second frame periods T2 are contained within a first duration H1 and a second duration H2. The first duration H1 has at least one of the first frame periods T1 and at least one of the second frame periods T2. Similarly, the second duration H2 has at least one of the first frame periods T1 and at least one of the second frame periods T2. However, the sequence of the first frame period T1 and the second frame period T2 within the first duration H1 is different from that within the second duration H2. The sequence of the first frame period T1 and the second frame period T2 within the first duration H1 is T1→T2, and the sequence of the first frame period T1 and the second frame period T2 within the second duration H2 is T2→T1. As shown in FIG. 22, the first one of the second frame period(s) T2 within the second duration H2 is adjacent to the last one of the second frame period(s) T2 within the first duration H1. It should be noted that the numbers of the first frame period(s) T1 and the second frame period(s) T2 within each of the first duration H1 and the second duration H2 should be a multiple of 2. In other words, the total number of the first frame period(s) T1 and the second frame period(s) T2 within the first duration H1 or the second duration H2 could be 2, 4, 6, 8, and so on.

Figure 23:
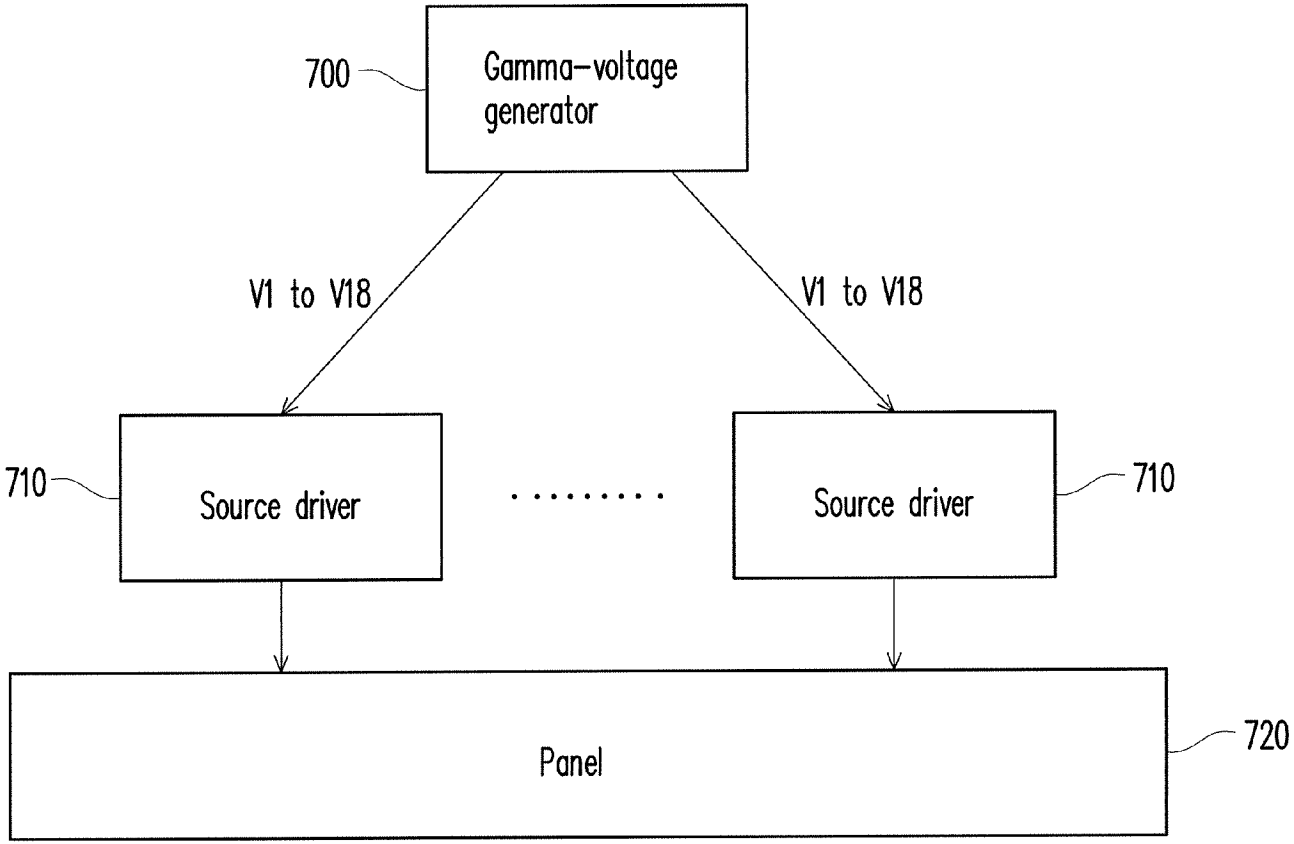
FIG. 23 is a schematic diagram of a gamma-voltage generator coupled to a plurality of source drivers and a panel of a display according to an embodiment of the invention.

The gamma-voltage generator of the invention could provide the gamma voltages to one or more source drivers. Please refer to FIG. 23. FIG. 23 is a schematic diagram of a gamma-voltage generator 700 coupled to a plurality of source drivers 710 and a panel 720 of a display according to an embodiment of the invention. The gamma-voltage generator 700 generates and provides the gamma voltages V1 to V18 to each of the source drivers 710. The source drivers 710 driver the pixel of the panel 720 based on the gamma voltages V1 to V18, such that the panel 720 could display images. In an embodiment of the invention, the gamma-voltage generator 700 could be the gamma-voltage generator 100, 300, 400, 500 or 600.

In one embodiment of the invention, the gamma-voltage generator (e.g. the gamma-voltage generator 100, 300, 400, 500, 600 or 700) is a programmable gamma (P-Gamma) buffer. Moreover, the gamma-voltage generator could be integrated with other circuit of a display. For example, in one embodiment of the invention, the gamma-voltage generator is integrated with a common-voltage (Vcom) buffer, which is configured to provide the common voltage to a panel of a display. In one embodiment of the invention, the gamma-voltage generator is integrated with a circuit of a timing controller (TCON), which is configured to generating timing signals for controlling operations of a display. In one embodiment of the invention, the gamma-voltage generator is integrated with a circuit of a power IC, which is configured to manage power of a display.

Figure 24:
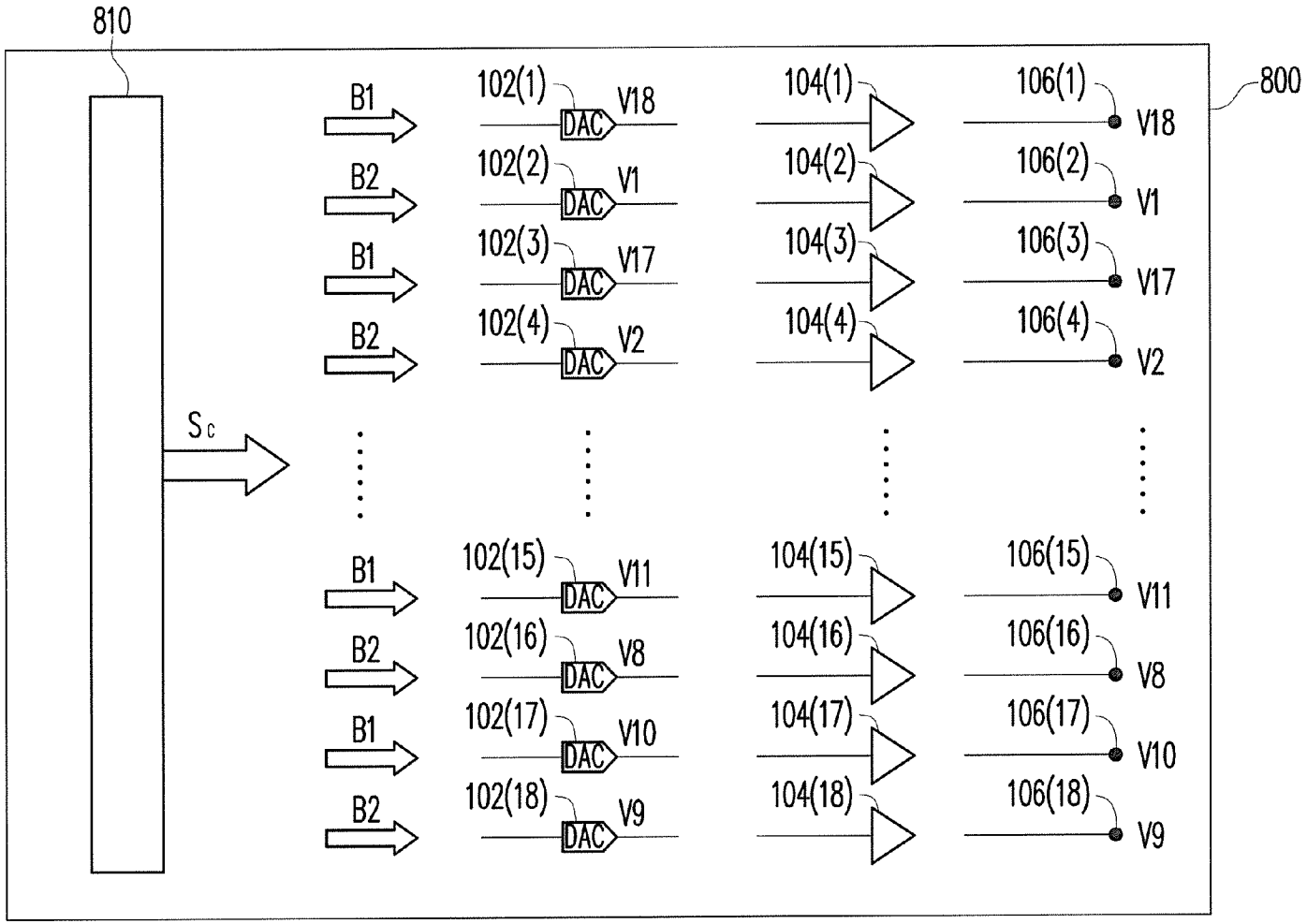
FIG. 24 is a schematic diagram of a gamma-voltage generator according to an embodiment of the invention.

In one embodiment of the invention, the gamma-voltage generator (e.g. the gamma-voltage generator 100, 300, 400, 500, 600 or 700) further comprises a memory for storing a setting value and generating the digital signal $S_C$ according to the setting value. Referring to FIG. 24, FIG. 24 is a schematic diagram of a gamma-voltage generator 800 according to an embodiment of the invention. The gamma-voltage generator 800 could be the gamma-voltage generator 100, 300, 400, 500 or 600, and has a memory 810. The memory 810 is a non-volatile memory, e.g. a one-time programmable (OTP) memory, an electrically-erasable programmable Read-Only Memory (EPPROM), flash memory, etc. The memory 810 is used to storing a setting value and generating the digital signal $S_C$ according to the setting value.

In light of the foregoing, a gamma-voltage generator is provided to generating a plurality of first gamma voltages and second gamma voltages. At least one of the first gamma voltages generated by DACs of the gamma-voltage generator within a first frame period and at least one of the second gamma voltages generated by the DACs within a second frame period are outputted from a same one of the gamma buffers of the gamma-voltage generator, whereby the transmitted gamma voltages have substantially equal offset. Therefore, the display quality approaches an ideal condition.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A gamma-voltage generator, comprising:

a plurality of digital-to-analog converters (DACs), converting a digital signal, into a plurality of gamma voltages;

a plurality of gamma buffers, coupled to the DACs, buffering the gamma voltages and outputting the buffered gamma voltages;

a plurality of terminals, coupled to the gamma buffers, receiving and outputting the buffered gamma voltages;

a first switching circuit, coupled between the DACs and the gamma buffers; and a second switching circuit, coupled between the gamma buffers and the terminals, wherein the first switching circuit and the second switching circuit are configured such that at least one of a plurality of first gamma voltages of the gamma voltages generated by the DACs within a first period and at least one of a plurality of second gamma voltages of the gamma voltages generated by the DACs within a second period are outputted from a same one of the gamma buffers.

2. The gamma-voltage generator as claimed in claim 1, wherein the DACs comprise a plurality of first DACs and a plurality of second DACs, the gamma buffers comprise a plurality of first gamma buffers and a plurality of second buffers, the first switching circuit connects the first DACs to the first gamma buffers and connects the second DACs to the second gamma buffers within the first period, and the first switching circuit connects the first DACs to the second gamma buffers and connects the second DACs to the first gamma buffers within the second period;

wherein the terminals comprise a plurality of first terminals and a plurality of second terminals, the second switching circuit connects the first gamma buffers to the first terminals and connects the second gamma buffers to the second terminals within the first period, and the second switching circuit connects the first gamma buffers to the second terminals and connects the second gamma buffers to the first terminals within the second period.

3. A gamma-voltage generator, comprising:

a plurality of digital-to-analog converters (DACs), converting a digital signal, into a plurality of gamma voltages;

a plurality of gamma buffers, coupled to the DACs, buffering the gamma voltages and outputting the buffered gamma voltages;

a plurality of terminals, coupled to the gamma buffers, receiving and outputting the buffered gamma voltages;

a first switching circuit, coupled to the DACs, and receiving the digital signal; and a second switching circuit, coupled between the gamma buffers and the terminals, wherein the first switching circuit and the second switching circuit are configured such that at least one of a plurality of first gamma voltages of the gamma voltages generated b the DACs within a first period and at least one of a plurality of second gamma voltages of the gamma voltages generated by the DACs within a second period are outputted from a same one of the gamma buffers.

4. The gamma-voltage generator as claimed in claim 3, wherein the DACs comprise a plurality of first DACs and a plurality of second DACs, the gamma buffers comprise a plurality of first gamma buffers and a plurality of second gamma buffers, the first switching circuit transmits the first bits of the digital signal to the first DACs and transmits the second bits of the digital signal to the second DACs within the first period, and the first switching circuit transmits the second bits of the digital signal to the first DACs and transmits the first bits of the digital signal to the second DACs within the second period;

wherein the terminals comprise a plurality of first terminals and a plurality of second terminals, the second switching circuit connects the first gamma buffers to the first terminals and connects the second gamma buffers to the second terminals within the first period, and the second switching circuit connects the first gamma buffers to the second terminals and connects the second gamma buffers to the first terminals within the second period.

5. The gamma-voltage generator as claimed in claim 3, wherein the DACs comprise a plurality of first DACs and a plurality of second DACs, the first DACs generate the first gamma voltages of the gamma voltages according to first bits of the digital signal within the first period and generate the second gamma voltages of the gamma voltages according to a plurality of second bits of the digital signal within the second period, and the second DACs generate the first gamma voltages according to the first bits of the digital signal within the second period and generate the second gamma voltages according to the second bits of the digital signal within the first period.

6. The gamma-voltage generator as claimed in claim 3, wherein the first switching circuit comprises a first register and a second register.

7. The gamma-voltage generator as claimed in claim 3, wherein first sections of the first register temporarily store a plurality of first bits of the digital signal, and second sections of the first register temporarily store a plurality of second bits of the digital signal, and first sections of the second register receive one of the first bits and the second bits of the digital signal from one of the first sections and the second sections of the first register and output the one of the first bits and the second bits of the digital signal to first DACs of the DACs, and second sections of the second register receive the other one of the first bits and the second bits of the digital signal from the other one of the first sections and the second sections of the first register and output the other one of the first bits and the second bits of the digital signal to second DACs of the DACs.

8. The gamma-voltage generator as claimed in claim 7, wherein the first sections of the second register receive the first bits of the digital signal from the first sections of the first register and output the first bits of the digital signal to the first DACs within the first period, and the second sections of the second register receive the second bits of the digital signal from the second sections of the first register and output the second bits of the digital signal to the second DACs within the first period;

wherein the first sections of the second register receive the second bits of the digital signal from the second sections of the first register and output the second bits of the digital signal to the first DACs within the second period, and the second sections of the second register receive the first bits of the digital signal from the first sections of the first register and output the first bits of the digital signal to the second DACs within the second period.

9. The gamma-voltage generator as claimed in claim 3, wherein the DACs are further coupled to a non-volatile memory configured to store a setting value and generate the digital signal according to the setting value.

10. A gamma-voltage generator, comprising:

a plurality of digital-to-analog converters (DACs), converting a digital signal, into a plurality of gamma voltages, wherein the DACs comprise a plurality of first DACs and a plurality of second DACs;

a plurality of gamma buffers, coupled to the DACs, buffering the gamma voltages and outputting the buffered gamma voltages, wherein the gamma buffers comprise a plurality of first gamma buffers and a plurality of second gamma buffers, each of the gamma buffers coupled to a corresponding one of the first DACs and a corresponding one of the second DACs;

a plurality of terminals, coupled to the gamma buffers, receiving and outputting the buffered gamma voltages; and a switching circuit coupled between the gamma buffers and the terminals, wherein the switching circuit is configured such that at least one of a plurality of first gamma voltages of the gamma voltages generated by the DACs within a first period and at least one of a plurality of second gamma voltages of the gamma voltages generated by the DACs within a second period are outputted from a same one of the gamma buffers.

11. The gamma-voltage generator as claimed in claim 10, wherein the terminals comprise a plurality of first terminals and a plurality of second terminals, within the first period, the first gamma buffers receive the first gamma voltages of the gamma voltages from the corresponding first DACs, the second gamma buffers receive the second gamma voltages of the gamma voltages from the corresponding second DACs, and the switching circuit connects the first gamma buffers to first terminals and connects the second gamma buffers to second terminals, and within the second period, the first gamma buffers receive the second gamma voltages from the corresponding second DACs, the second gamma buffers receive the first gamma voltages from the corresponding first DACs, and the switching circuit connects the first gamma buffers to the second terminals and connects the second gamma buffers to the first terminals.

* * * * *